US009789884B2

(12) United States Patent
Yamaguchi et al.

(10) Patent No.: US 9,789,884 B2
(45) Date of Patent: Oct. 17, 2017

(54) RAILWAY VEHICLE PLUG DOOR DEVICE AND RAILWAY VEHICLE PLUG DOOR

(71) Applicant: NABTESCO CORPORATION, Tokyo (JP)

(72) Inventors: Atsuhito Yamaguchi, Hyogo (JP); Hitoshi Akiyama, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 14/405,976

(22) PCT Filed: Jun. 6, 2013

(86) PCT No.: PCT/JP2013/065659
§ 371 (c)(1),
(2) Date: Dec. 5, 2014

(87) PCT Pub. No.: WO2013/183699
PCT Pub. Date: Dec. 12, 2013

(65) Prior Publication Data

US 2015/0158503 A1 Jun. 11, 2015

(30) Foreign Application Priority Data

Jun. 6, 2012 (JP) ..... 2012-128565

(51) Int. Cl.
*B61D 19/00* (2006.01)
*B61D 19/02* (2006.01)
(Continued)

(52) U.S. Cl.
CPC ..... *B61D 19/009* (2013.01); *B61D 19/02* (2013.01); *E05D 15/1068* (2013.01);
(Continued)

(58) Field of Classification Search
CPC .. B61D 19/009; B61D 19/003; B61D 19/005; E05F 15/646
See application file for complete search history.

(56) References Cited

U.S. PATENT DOCUMENTS 1,734,755 A * 11/1929 Tobin et al. ..... 49/216
1,821,591 A * 9/1931 Tobin et al. ..... 49/216
(Continued)

FOREIGN PATENT DOCUMENTS

JP 61-87868 6/1986
JP 63-169318 11/1988
(Continued)

OTHER PUBLICATIONS

International Search Report issued in International Patent Application No. PCT/JP2013/065659, dated Sep. 10, 2013.
(Continued)

*Primary Examiner* — Katherine Mitchell
*Assistant Examiner* — Catherine A Kelly
(74) *Attorney, Agent, or Firm* — Pillsbury Winthrop Shaw Pittman LLP

(57) ABSTRACT

It is aimed to provide a railway vehicle plug door device capable of easily ensuring airtightness between a side structure body and a door leaf even if the railway vehicle plug door device is installed in a side structure body having a structure assembled by joining structural members by welding and including a bent part. A frame body is mounted on a part constituting an entrance in a side structure body by a mechanical fastening structure. A seal member is mounted on at least one of a door leaf and the frame body and held in close contact with both the door leaf and the frame body when the door leaf closes the entrance.

5 Claims, 14 Drawing Sheets

(51) Int. Cl.
*E05D 15/10* (2006.01)
*E05F 15/646* (2015.01)

(52) U.S. Cl.
CPC .... *E05F 15/646* (2015.01); *E05D 2015/1071* (2013.01); *E05Y 2201/406* (2013.01); *E05Y 2900/51* (2013.01)

(56) References Cited

U.S. PATENT DOCUMENTS

| | | | | | |
|---|---|---|---|---|---|
| 2,245,812 | A | * | 6/1941 | Osner et al. | 49/473 |
| 2,741,807 | A | * | 4/1956 | Powers | 49/219 |
| 2,902,122 | A | * | 9/1959 | Beauchamp | 49/426 |
| 2,992,462 | A | * | 7/1961 | Gutridge | 49/220 |
| 3,179,984 | A | * | 4/1965 | Bailey | 49/220 |
| 3,216,066 | A | * | 11/1965 | Hadacek | E06B 1/52 206/325 |
| 3,334,441 | A | * | 8/1967 | Landis et al. | 49/220 |
| 3,388,502 | A | * | 6/1968 | Ceyer et al. | 49/493.1 |
| 3,434,256 | A | | 3/1969 | Eggert, Jr. | |
| 3,452,481 | A | * | 7/1969 | Bailey | 49/489.1 |
| 3,474,571 | A | * | 10/1969 | Lemon | 49/218 |
| 3,513,783 | A | * | 5/1970 | Sahly et al. | 105/378 |
| 3,777,424 | A | * | 12/1973 | Nagy et al. | 49/480.1 |
| 4,150,509 | A | | 4/1979 | Knap | |
| 4,457,108 | A | * | 7/1984 | Kuschel et al. | 49/213 |
| 4,608,777 | A | * | 9/1986 | Okamoto | 49/214 |
| 5,263,280 | A | * | 11/1993 | Dilcher | 49/212 |
| 5,467,558 | A | * | 11/1995 | Kober et al. | 49/220 |
| 9,181,739 | B2 | * | 11/2015 | Baer | E05D 3/122 |

FOREIGN PATENT DOCUMENTS

| | | |
|---|---|---|
| JP | 5-16540 U | 3/1993 |
| WO | WO 01/85519 A1 | 11/2001 |

OTHER PUBLICATIONS

Extended European Search Report as issued in European Patent Application No. 13800596.2, dated Jan. 22, 2016.

* cited by examiner

RAILWAY VEHICLE PLUG DOOR DEVICE AND RAILWAY VEHICLE PLUG DOOR

CROSS-REFERENCE TO RELATED APPLICATIONS

This application is the U.S. National Stage of PCT/JP2013/065659, filed Jun. 6, 2013, which in turn claims priority to Japanese Patent Application No. 2012-128565, filed Jun. 6, 2012. The contents of all of these applications are incorporated herein by reference in their entirety.

TECHNICAL FIELD

The present invention relates to a plug door device to be installed at an entrance of a railway vehicle and particularly to a door structure of the plug door device.

BACKGROUND ART

Conventionally, a railway vehicle plug door device is known (see, for example, Patent Document 1. The railway vehicle plug door device requires a configuration for ensuring airtightness between a side structure body, which is a side wall structure part in a railway vehicle, and a door leaf when the door leaf closes an entrance.

To ensure airtightness between the door leaf and the side structure body, a seal member is disposed on the side structure body in the railway vehicle plug door disclosed in FIG. 5 of Patent Document 1. In this way, the above railway vehicle plug door is so configured that the seal member is held in close contact with the door leaf to ensure airtightness between the side structure body and the door leaf when the door leaf close an entrance.

PRIOR ART DOCUMENT

Patent Document

Patent Document 1: Japanese Utility Model Application Publication No. S61-87868

A side structure body of a railway vehicle mainly comprises a structure assembled by joining structural members by welding. Thus, in an assembled state of the side structure body, a residual stress due to the influence of heat at the time of welding is created and a distortion of a certain magnitude occurs.

On the other hand, in recent years, vehicle bodies designed with emphasis on designability have been on the increase as vehicle bodies of railway vehicles. Thus, there is a tendency of providing a bent part on a side structure body and complicating cross-sectional shapes of a door leaf and the side structure body. This leads to a tendency of complicating the arrangement and configuration of a seal member for ensuring airtightness between the side structure body and the door leaf.

If the arrangement and configuration of the seal member are complicated, a distortion caused by a residual stress due to welding affects the airtightness of the seal member and more largely affects airtightness between the side structure body and the door leaf. As a result, in a railway vehicle plug door installed in the side structure body having a complicated cross-sectional shape by including a bent part, airtightness between the side structure body and the door leaf may be reduced unless a process for reducing the distortion is applied.

Note that, at present, the process for reducing the distortion is possible as described above, but it is difficult to reduce the distortion to a sufficiently low level. Further, man-hour and cost required to assemble the side structure body increase as a higher degree of distortion reduction is desired and a higher requirement level for distortion reduction is set.

SUMMARY OF THE INVENTION

In view of the above actual situation, an object of the present invention is to provide a railway vehicle plug door device capable of easily ensuring airtightness between a side structure body and a door leaf even if the railway vehicle plug door device is installed in the side structure body having a structure assembled by joining structural members by welding and including a bent part, and a railway vehicle plug door used as a door structure in the railway vehicle plug door device.

A railway vehicle plug door device according to one aspect of the invention to achieve the above object relates to a railway vehicle plug door device to be installed at an entrance of a railway vehicle and configured to perform an operation of opening and closing a door leaf and a plugging operation of moving the door leaf in a width direction of the railway vehicle. The railway vehicle plug door device according to one aspect of the invention includes a door driving mechanism including a motor generating a power for opening and closing the door leaf, a frame body to be mounted on a constituting defining the entrance in a side wall of the railway vehicle by a mechanical fastening structure, the door leaf having a shape for opening and closing the entrance, and a seal member mounted on at least one of the door leaf or the frame body and held in close contact with both the door leaf and the frame body when the door leaf closes the entrance, wherein the door leaf has a bent shape, and the frame body is bent in conformity with the bent shape of the door leaf.

According to this configuration, the frame body provided separately from the side structure body is mounted on the part constituting the entrance in the side structure body of the railway vehicle. The frame body is mounted in the side structure body by the mechanical fastening structure. Thus, even if the side structure body has a structure assembled by joining structural members by welding and a complicated cross-sectional shape by including a bent part, the influence of a distortion of the side structure body caused by a residual stress due to welding on the frame body can be easily reduced. Since the seal member is mounted on either the door leaf or the frame body and held in close contact with the door leaf and the frame body, the influence of the distortion of the side structure body caused by the residual stress due to welding on the close contact of the seal member is also drastically reduced. In this way, a structure for easily reducing the influence of the above distortion on airtightness between the side structure body and the door leaf is realized. Thus, it is possible to provide a railway vehicle plug door device in which airtightness between a side structure body and a door leaf is easily ensured.

As described above, according to the above configuration, it is possible to provide a railway vehicle plug door device capable of easily ensuring airtightness between a side structure body and a door leaf even if the railway vehicle plug door device is installed in the side structure body having a structure assembled by joining structural members by welding and including a bent part.

In the railway vehicle plug door device, the frame body may be disposed along an entire circumference of the entrance, and the seal member may be disposed to correspond, in a state where the entrance is closed by the door leaf, to the entire circumference of the entrance.

According to this configuration, since the frame body and the seal member are arranged along the entrance over an entire circumference of the entrance in a closed state of the door leaf, airtightness between the side structure body and the door leaf can be more easily ensured.

In the railway vehicle plug door device, the mechanical fastening structure may include a fastening member provided separately from the side wall and the frame body and fastens the side wall and the frame body via the fastening member.

According to this configuration, since the side structure body and the frame body are mechanically fastened via the fastening member separate from the side structure body and the frame body, the frame body can be easily mounted in the side structure body. Further, since the frame body is fastened to the side structure body via the separate fastening member, a structure capable of easily reducing the influence of a distortion of the side structure body caused by a residual stress due to welding on the frame body can be more easily realized.

In the railway vehicle plug door device, the seal member may be mounted on the door leaf and and may be in contact with the frame body at least at three positions in a cross section along a direction parallel to a direction of pressing the seal member against the frame body and an outward direction from the entrance along the side wall when the seal member comes into contact with and being pressed against the frame body by closing the entrance by the door leaf. Alternatively, the seal member may be mounted on the frame body and may be in contact with the door leaf at least at three positions in a cross section along a direction parallel to a direction of pressing the seal member against the door leaf and an outward direction from the entrance along the side wall when the seal member comes into contact with and being pressed against the door leaf by closing the entrance by the door leaf.

According to this configuration, the seal member is in contact with the door leaf or the frame body at least at three positions in the cross section along the direction parallel to the direction of pressing the seal member against the door leaf or the frame body and the outward direction from the entrance along the side structure body. Thus, the seal member can efficiently ensure a contact state at three or more dispersed positions as compared with the case where the seal member is in contact with the door leaf or the frame body only at one or two positions. In this way, airtightness between the side structure body and the door leaf can be more easily ensured.

As an invention according to one aspect, it is also possible to constitute an invention of a railway vehicle plug door. A railway vehicle plug door according to one aspect of the invention relates to a railway vehicle plug door used as a door structure including a door leaf in a plug door device to be installed at an entrance of a railway vehicle and configured to perform an operation of opening and closing the door leaf and a plugging operation of moving the door leaf in a width direction of the railway vehicle. The railway vehicle plug door according to one aspect of the invention includes a frame body to be mounted on a part defining the entrance in a side wall of the railway vehicle by a mechanical fastening structure, the door leaf having a shape for opening and closing the entrance, and a seal member mounted on at least one of the door leaf or the frame body and held in close contact with both the door leaf and the frame body when the door leaf closes the entrance, wherein the door leaf has a bent shape, and the frame body is bent in conformity with the bent shape of the door leaf.

According to this configuration, effects similar to those of the railway vehicle plug door device according to the first aspect of the invention can be achieved. Specifically, according to this configuration, it is possible to provide a railway vehicle plug door capable of easily ensuring airtightness between a side structure body and a door leaf even if the railway vehicle plug door is installed in the side structure body having a structure assembled by joining structural members by welding and including a bent part.

Effect of the Invention

According to the present invention, it is possible to provide a railway vehicle plug door device capable of easily ensuring airtightness between a side structure body and a door leaf even if the railway vehicle plug door device is installed in the side structure body having a structure assembled by joining structural members by welding and including a bent part, and a railway vehicle plug door used as a door structure in the railway vehicle plug door device.

BEST MODE FOR CARRYING OUT THE INVENTION

Hereinafter, an embodiment of the present invention is described with reference to the drawings. The present invention can be applied as a railway vehicle plug door device which is installed at an entrance of a railway vehicle and performs an operation of opening and closing a door leaf and a plugging operation of moving the door leaf in a width direction of the railway vehicle, and as a railway vehicle plug door used as a door structure in the railway vehicle plug door device. Note that this embodiment is described with respect an example in which the present invention is applied to a single sliding door structure including one door leaf. However, without being limited to this example, the present invention may be applied to a double sliding door structure including two door leaves.

Figure 1:
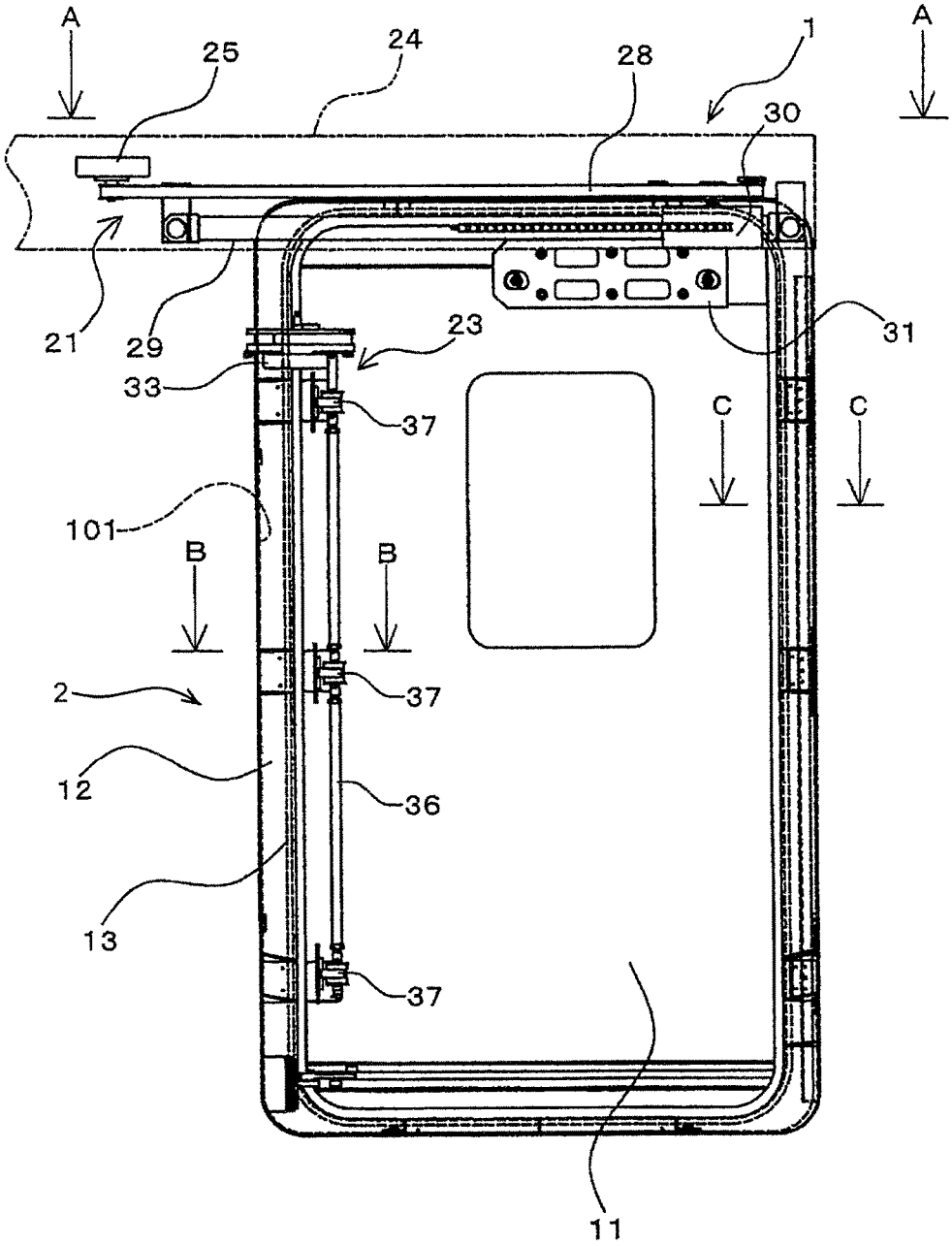
FIG. 1 is a diagram entirely showing a railway vehicle plug door device according to one embodiment of the present invention.
Figure 2:
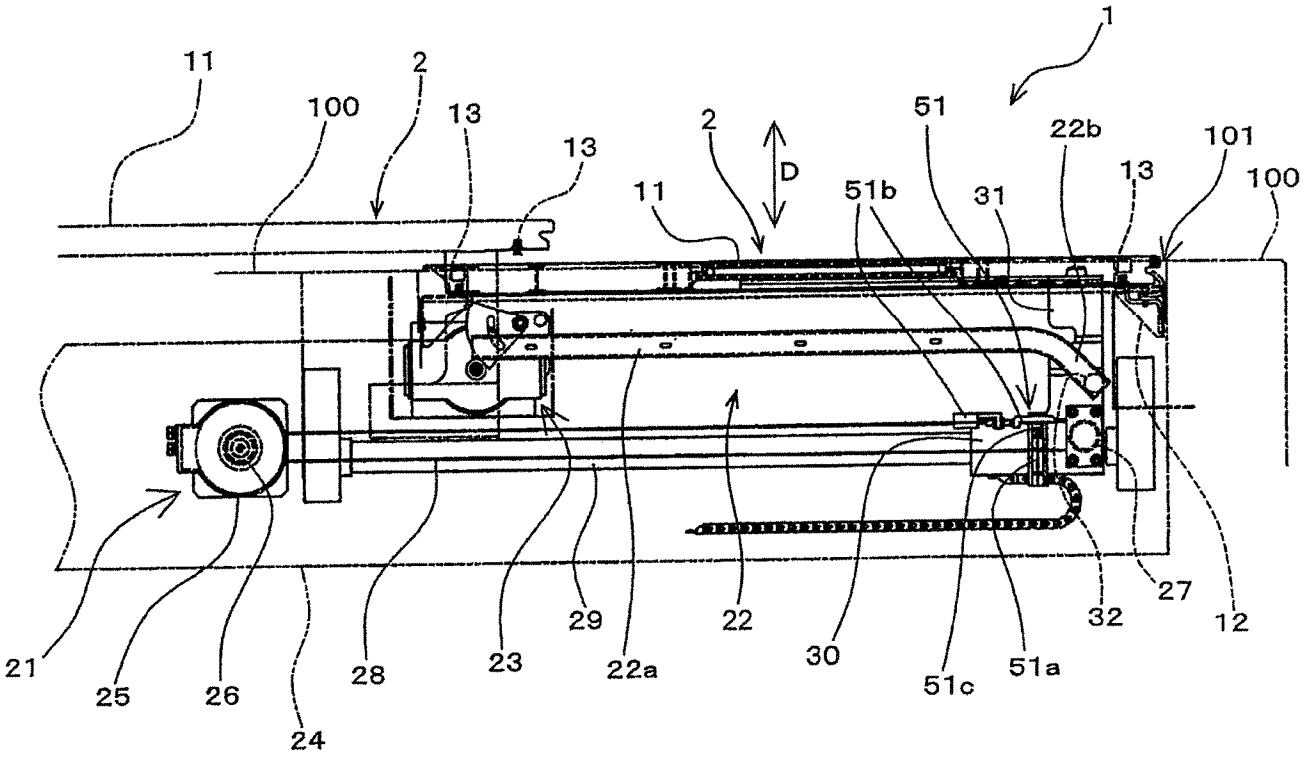
FIG. 2 is a diagram showing the railway vehicle plug door device viewed from a position indicated by arrows A-A of FIG. 1.

FIG. 1 is a diagram entirely showing a railway vehicle plug door device 1 (hereinafter, also merely referred to as a "plug door device 1") according to one embodiment of the present invention. FIG. 2 is a diagram showing the plug door device 1 viewed from a position indicated by arrows A-A of FIG. 1. Further, as shown in FIGS. 1 and 2, a railway vehicle plug door 2 (hereinafter, also merely referred to as a "plug door 2") according to one embodiment of the present invention is used as a door structure in the plug door device 1.

The plug door device 1 shown in FIGS. 1 and 2 is configured as a plug door device including the plug door 2 as a single sliding door structure including one door leaf. The plug door device 1 is installed at an entrance 101 of a railway vehicle. FIG. 1 is a diagram viewed from the inside of the railway vehicle showing a state where the plug door device 1 is installed at the entrance 101 of the railway vehicle. In FIG. 2, a part of a side structure body 100, which is a side wall structure part in the railway vehicle, is shown in chain double-dashed line. On the other hand, the side structure body 100 is not shown in FIG. 1. Note that the side structure body 100 is configured as a side structure body having a structure assembled by joining a plurality of structural members by welding and including a bent part.

Further, FIGS. 1 and 2 schematically show the plug door device 1 or a part of the side structure body 100 and the illustration of members, parts and the like not related to the gist of the description of this embodiment is omitted as appropriate. Further, similarly, FIGS. 3 to 10 to be described later are also schematically shown and the illustration of members, parts and the like not related to the gist of the description of this embodiment is omitted as appropriate.

The plug door device 1 and the plug door 2 used in the plug door device 1 are described below. Note that, in the following description, the plug door device 1 is first described and the plug door 2 is then described.

The plug door device 1 shown in FIGS. 1 and 2 is configured as a device for performing an operation of opening and closing a door leaf 11 of the plug door 2 as the door structure and a plugging operation of moving the door leaf 11 in a width direction of a railway vehicle. FIGS. 1 and 2 show a state where the entrance 101 is closed by the door leaf 11. Further, the position of the door leaf 11 in a state where the entrance 101 is open is also shown in chain double-dashed line in FIG. 2. Note that the width direction of the railway vehicle described above (hereinafter, also referred to as a "vehicle width direction") is a direction perpendicular to a front-back direction and a vertical direction of the railway vehicle and indicated by a two-way arrow D in FIG. 2. The front-back direction of the railway vehicle is a direction parallel to a traveling direction of the railway vehicle.

The plug door device 1 includes the plug door 2, a door driving mechanism 21, a guide rail 22, a pull-in actuator 23, a fixed base, a slide base and the like. Note that the fixed base and slide base are not shown.

The fixed base is provided as a supporting member mounted on the side structure body 100 and configured to support the slide base and the door driving mechanism 21. The fixed base is fixed so as not to move relative to the side structure body 100. Further, a rail mechanism for supporting the slide base slidably in the vehicle width direction is, for example, provided on the fixed base.

The slide base is disposed on the fixed base movably relative to the fixed base in the vehicle width direction. Wheels which move by rolling relative to the rail mechanism of the fixed base are, for example, provided on the slide base. Further, a part of the door driving mechanism 21 is disposed on the slide base. This makes a part of the door driving mechanism 21 movable relative to the fixed base in the vehicle width direction together with the slide base while being guided by the guide rail 22 to be described later when the door driving mechanism 21 operates.

Figure 3:
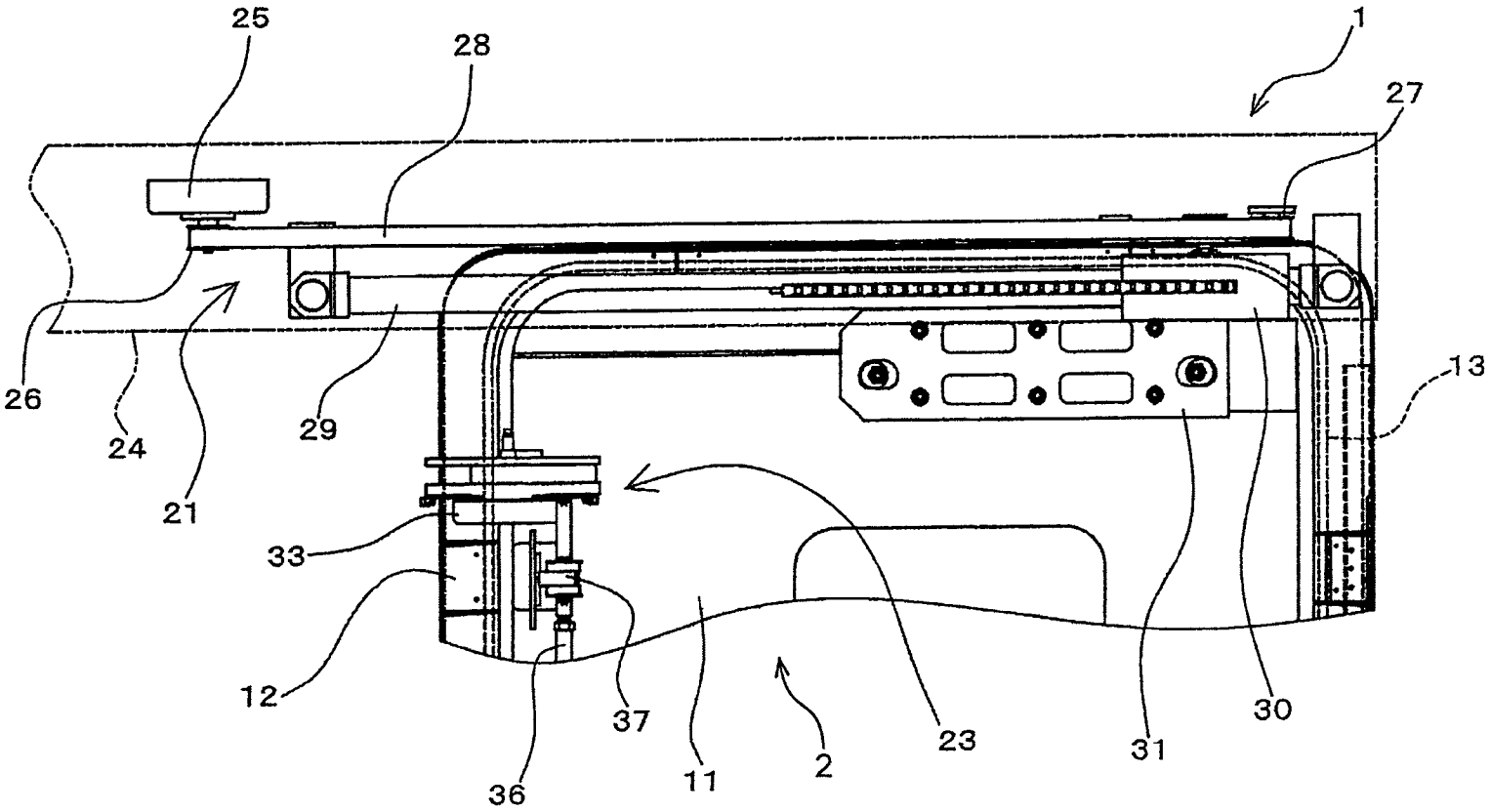
FIG. 3 is a diagram enlargedly showing a part of FIG. 1 to show an upper part of the railway vehicle plug door device.

FIG. 3 is a diagram enlargedly showing a part of FIG. 1 to show an upper part of the plug door device 1. The door driving mechanism 21 shown in FIGS. 1 to 3 is provided as a mechanism for opening and closing the door leaf 11. The door driving mechanism 21 is disposed near an upper part of the entrance 101 and housed together with the slide base in a casing (not shown) defining a housing space 24 shown in chain double-dashed line.

The door driving mechanism 21 includes an open-close drive motor 25, a drive pulley 26, a driven pulley 27, a belt 28, a guide pipe 29, a guide block 30, a door hanger 31, a linear guide 51 and the like. The open-close drive motor 25 and the driven pulley 27 are fixed to the fixed base. The guide pipe 29 is fixed to the slide base.

The open-close drive motor 25 is provided as an electric motor and drives the drive pulley 26. The drive pulley 26 is, for example, coupled to an output shaft of the open-close drive motor 25 and configured to rotate together with the output shaft of the open-close drive motor 25. A drive force of the drive pulley 26 is transmitted to the driven pulley 27 via the belt 28, and the driven pulley 27 is configured to rotate according to the rotation of the drive pulley 26.

The belt 28 is formed as an endless turning belt mounted on the drive pulley 26 and the driven pulley 27. The belt 28 mounted on the drive pulley 26 and the driven pulley 27 is arranged to extend substantially in parallel to the front-back direction of the railway vehicle between the drive pulley 26 and the driven pulley 27. Further, the belt 28 is relatively displaceably coupled to the guide block 30 via the linear guide 51.

The guide pipe 29 is provided as a hollow cylindrical pipe member and so arranged that an axial direction as a longitudinal direction thereof extends substantially in parallel to the front-back direction of the railway vehicle. Both of end parts of the guide pipe 29 are fixed to the slide base.

The guide block 30 is provided as a block member formed with a through hole which has a circular cross-section and into which the guide pipe 29 is to be inserted. The guide block 30 is disposed freely slidably relative to the guide pipe 29 along the axial direction of the guide pipe 29. Further, the guide block 30 is coupled to the belt 28 via the linear guide 51.

The linear guide 51 is provided as a coupling mechanism for coupling the guide block 30 and the belt 28 relatively displaceably with respect to each other. The linear guide 51 is configured to allow a relative displacement of the guide block 30 with respect to the belt 28 in the vehicle width direction when the belt 28 moves in a turning direction. Further, the linear guide Si includes a linear slide supporting portion 51*a*, a belt mounting portion 51*b*, a linear slider 51*c* and the like.

The linear slide supporting portion 51*a* is fixed to the guide block 30. A rail-like guide portion for slidably supporting the block-like slider 51*c* is provided on the linear slide supporting portion 51*a*. This guide portion is provided to extend straight on the linear slide supporting portion 51*a*. In this way, the slider 51*c* is supported freely slidably relative to the linear slide supporting portion 51*a* along a linear direction.

The belt mounting portion 51*b* is provided as a member including a part to be fixed and mounted on the belt 28 and configured to couple the belt 28 and the slider 51*c*. A part of the belt mounting portion 51*b* mounted on the belt 28 is fixed to the belt 28 at one of a pair of strip-like parts of the belt extending in parallel between the drive pulley 26 and the driven pulley 27.

By the above configuration, the linear slide supporting portion 51*a* is made slidable in the vehicle width direction relative to the slider 51*c* fixed to the belt mounting portion 51*b* which is displaced in the front-back direction of the railway vehicle together with the belt 28 when the belt 28 moves in the turning direction. When the guide block 30 moves in the vehicle width direction together with the guide block 30 as being guided by the guide rail 22 to be described later, the linear slide supporting portion 51*a* fixed to the guide block 30 slides in the vehicle width direction relative to the slider 51*c*. In this way, a relative movement of the guide block 30 with respect to the belt 28 in the vehicle width direction is allowed when the belt 28 moves in the turning direction.

The door hanger 31 is provided as a member for supporting the door leaf 11 while hanging the door leaf 11 and coupling the guide block 30 and the door leaf 11. The door hanger 31 is, for example, formed by a plate-like extending member including a bent part. One end side of the door hanger 31 is fixed to the guide block 30 and the other end side thereof is fixed to the door leaf 11. In this way, the door hanger 31 is configured to move together with the guide block 30 and drive the door leaf 11.

The door driving mechanism 21 is configured to be able to open and close the door leaf 11 by having the aforementioned configuration. Specifically, when the door driving mechanism 21 operates, the open-close drive motor 25 operates, whereby the drive pulley 26 rotates and the belt 28 mounted on the drive pulley 26 and the driven pulley 27 is displaced in the turning direction. Associated with this, the guide block 30 coupled to the belt 28 via the linear guide 51 moves while being guided by the guide pipe 29 supported on the slide base. Then, the guide block 30 coupled to the belt 28 via the linear guide 51 relatively displaceably in the vehicle width direction moves together with the door hanger 31 and the door leaf 11 moves together with the door hanger 31. In this way, the door hanger 11 is opened and closed.

The guide rail 22 is provided as a rail member for guiding a moving direction of the door hanger 31. The guide rail 22 is also provided as a guide mechanism of this embodiment for guiding a movement of the door leaf 11 in the vehicle width direction. The guide rail 22 is fixed to the fixed base or the side structure body 100. The guide rail 22 is configured, for example, as a member formed with a groove-like concave surface by bending opposite edge parts extending in parallel to a longitudinal direction in a long and narrow plate-like member.

Further, the guide rail 22 is so disposed on the fixed base or the side structure body 100 as to horizontally extend in a state where the groove-like concave surface is open downward. In the guide rail 22, a rolling surface on which a roller 32 freely rotatably mounted on the door hanger 30 rolls is provided on the above concave surface. The roller 32 rolls along the rolling surface of the guide rail 22 when the door hanger 31 moves together with the guide block 30, whereby the door hanger 31 and the guide block 30 are guided to move in a direction along the guide rail 22. Note that the roller 32 is provided on an upper part of the door hanger 31 and mounted on the door hanger 31 freely rotatably about a rotary shaft having an axial direction extending in the vertical direction. Further, the roller 32 is arranged in a state inserted at the inside of the concave surface of the guide rail 22.

Further, the guide rail 22 includes an opening-closing rail part 22*a* and a plugging rail part 22*b*. The opening-closing rail part 22*a* is provided as a part extending long in parallel with the front-back direction of the railway vehicle. The plugging rail part 22*b* is provided as a part disposed at one end side of the opening-closing rail part 22*a* in the longitudinal direction and bent with respect to the opening-closing rail part 22*a* and obliquely extending. The above smoothly continuous rolling surface is formed on both the opening-closing rail part 22*a* and the plugging rail part 22*b*.

Further, the plugging rail part 22*b* is provided for the plugging operation of moving the door leaf 11 in the vehicle width direction when the door leaf 11 is opened and closed by the door driving mechanism 21. Thus, the plugging rail part 22*b* is arranged at a door head side with respect to the opening-closing rail part 22*a*. Here, the door head side is an end side of the door leaf 11 in a moving direction when the door leaf 11 is closed, i.e. an end side in a closing direction of the door leaf 11. Note that a door tail side is an end side of the door leaf 11 in a moving direction when the door leaf 11 is opened, i.e. an end side in an opening direction of the door leaf 11.

By providing the guide rail 22 as described above, the opening/closing operation and the plugging operation of the door leaf 11 are smoothly performed when the door driving mechanism 21 operates. For example, in opening the closed door leaf 11, the roller 32 moves together with the door hanger 31 when the door driving mechanism 21 operates and the door hanger 31 starts moving. The roller 32 moves while rolling along the guide rail 22. When the roller 32 moves along the plugging rail part 22*b*, the door hanger 31, the guide block 30, the guide pipe 29, the linear slide supporting portion 51*a* of the linear guide 51 and the door leaf 11 move in the vehicle width direction together with the roller 32. At this time, the slide base on which the part of the door driving mechanism 21 is disposed slides in the vehicle width direction relative to the fixed base. In this way, the plugging operation of the door leaf 11 is performed. Note that the plugging operation in the case of closing the door leaf 11 is performed by a movement in a direction opposite to the above.

Figure 4:
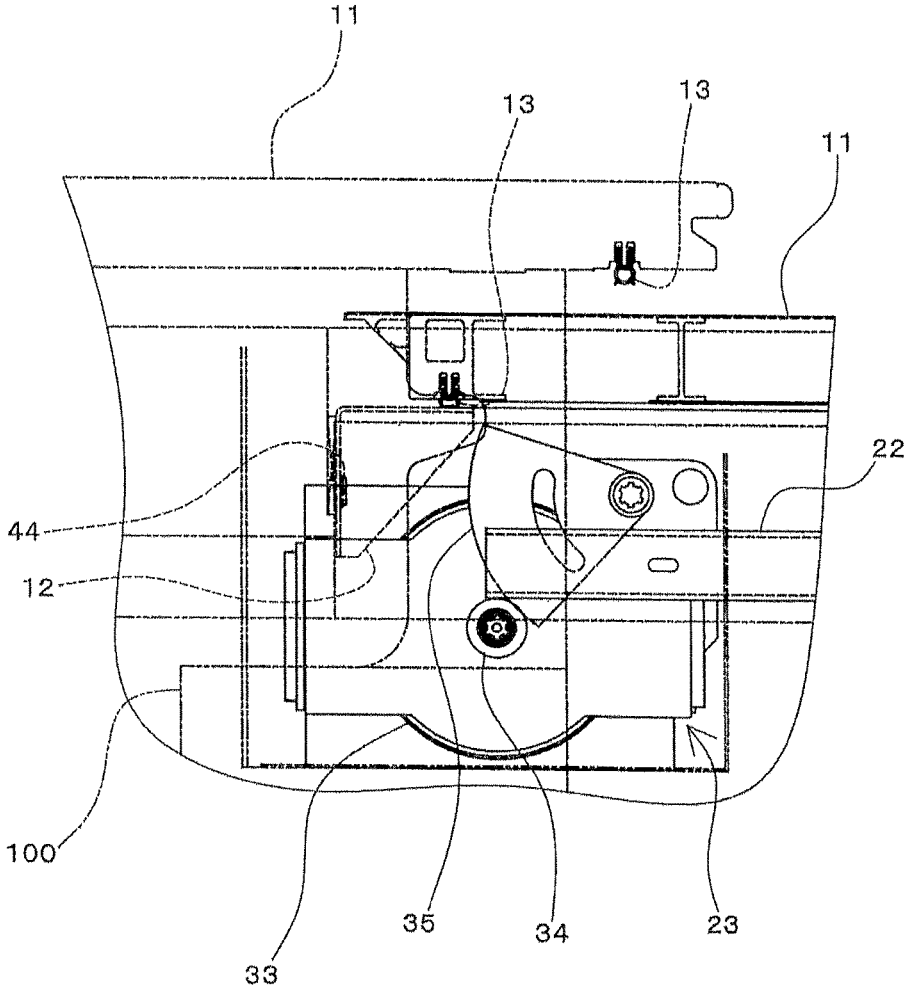
FIG. 4 is a diagram enlargedly showing a part of FIG. 2 to show the vicinity of a pull-in actuator.

FIG. 4 is a diagram enlargedly showing a part of FIG. 2 to show the vicinity of the pull-in actuator 23. The pull-in actuator 23 shown in FIGS. 1 to 4 is configured as an actuator for biasing the door leaf 11 to press the door leaf 11 in a pull-in direction toward the side structure body 10 when the door leaf 11 is closed. An operation of biasing the door leaf 11 in the pull-in direction by the operation of the pull-in actuator 23 is performed at a timing at which the plugging operation at the time of closing the door leaf 11 is completed.

The pull-in actuator 23 is disposed in the side structure body 100. The pull-in actuator 23 includes a pull-in drive motor 33, a spur gear 34 having a small diameter, a spur gear 35 having a large diameter, a rotary shaft 36, a plurality of latch members 37 and the like.

The pull-in drive motor 33 is provided as an electric motor and configured to rotate and drive the rotary shaft 36 about a center axis line of the rotary shaft 36 via the spur gears 34, 35. Note that the rotary shaft 36 is rotated and driven in a predetermined angle range in a rotating direction about the center axis line thereof. The spur gear 34 has teeth formed on the outer periphery and is coupled to an output shaft of the pull-in drive motor 33. The spur gear 34 is configured to rotate together with the output shaft of the pull-in drive motor 33.

The spur gear 35 is provided as a gear supported rotatably in a rotating direction about the center axis line of the rotary shaft 36. The spur gear 35 includes an outer peripheral part arranged to extend along an arc of a circle centered on the center axis line of the rotary shaft 36. This outer peripheral part is formed with teeth engaged with the spur gear 34.

Figure 5:
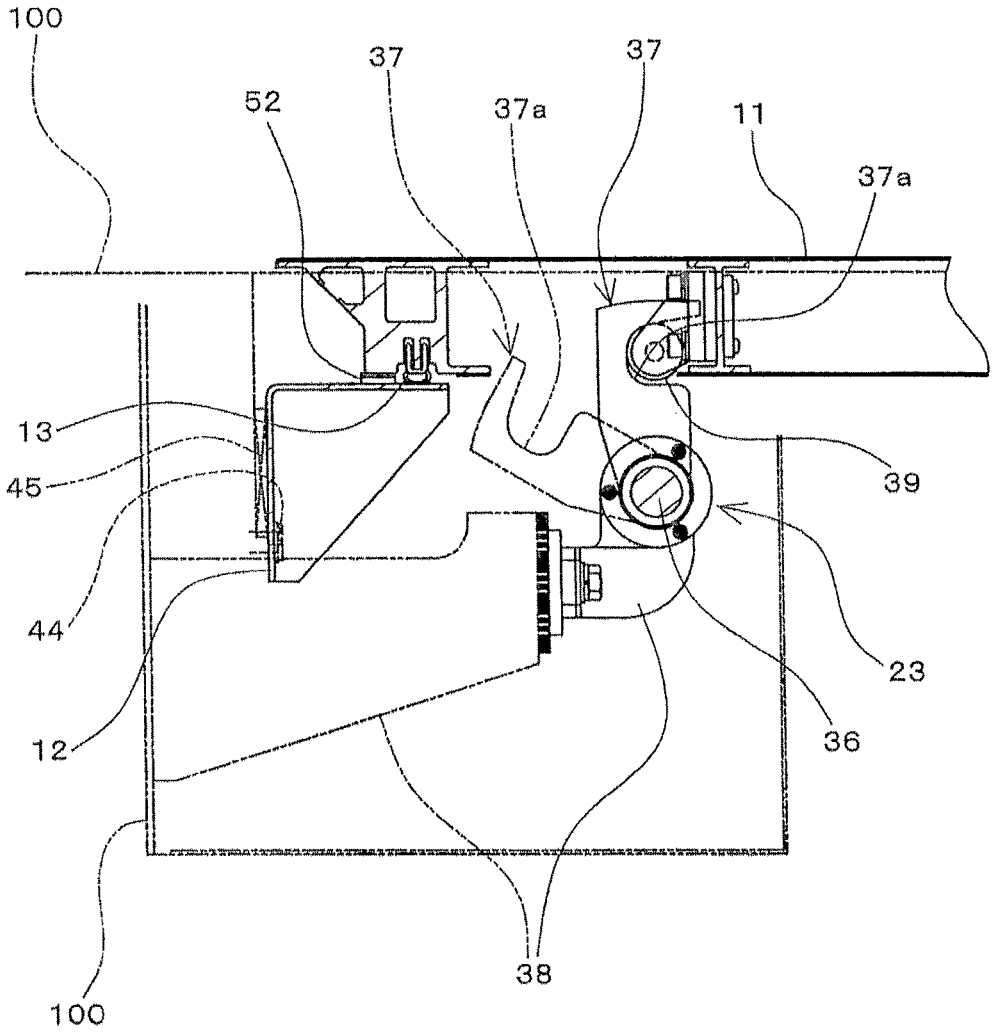
FIG. 5 is a diagram showing a cross-section of a part of the railway vehicle plug door device viewed from a position indicated by arrows B-B of FIG. 1.

The rotary shaft 36 is so disposed that the center axis line thereof extends in the vertical direction. The spur gear 35 is mounted on an upper end part of the rotary shaft 36. FIG. 5 is a diagram showing a cross-section of a part of the plug door device 1 viewed from a position indicated by arrows B-B of FIG. 1. As shown in FIG. 5, the rotary shaft 36 is mounted on the side structure body 100 via brackets 38. For example, the brackets 38 are provided at three positions along the vertical direction and the rotary shaft 36 is mounted on the side structure body 100 via three brackets 38 (see FIG. 1). The rotary shaft 36 is freely rotatably supported on each bracket 38, and freely rotatably disposed in the rotating direction about the center axis line thereof.

The latch member 37 is disposed to rotate together with the rotary shaft 36 about the center axis line of the rotary shaft 36 and provided as a member for holding the door leaf 11 by pulling the door leaf 11 toward an inner side in the vehicle width direction. A plurality of latch members 37 are provided along the vertical direction of the rotary shaft 36. In this embodiment, three latch members 37 are provided. One end part of each latch member 37 is fixed to the rotary shaft 36 in a cantilever manner. In this way, each latch member 37 is configured to rotate according to the rotation of the rotary shaft 36. Note that, in FIG. 5, the position of the latch member 37 in a state where the door leaf 11 is closed is shown in solid line and that of the latch member 37 in a state where the door leaf 11 is open is shown in chain double-dashed line.

Further, a recess 37*a* to be engaged with a pull-in roller 39 provided on the door leaf 11 is provided on the other end part of the latch member 37, i.e. an end part of the latch member 37 opposite to that fixed to the rotary shaft 36. The pull-in roller 39 is provided on a part of the door tail side of the door leaf 11. Further, a plurality of (three in this embodiment) pull-in rollers 39 are provided at positions corresponding to the respective latch members 37 in a vertical direction of the door leaf 11.

By having the configuration, the pull-in actuator 23 is provided so as to bias and press the door leaf 11 in the pull-in direction toward the side structure body 100 when the door leaf 11 is closed. First, when the door leaf 11 is closed, the pull-in drive motor 33 operates based on a command signal from an unillustrated controller. Associated with this, the spur gear 34 coupled to the output shaft of the pull-in drive motor 33 rotates in the rotating direction and the spur gear 35 engaged with the spur gear 34 also rotates.

By the above, the rotary shaft rotates about the center axis line thereof together with the spur gear 35 and each latch member 37 also rotates. The recess 37*a* of each rotating latch member 37 is engaged with the corresponding pull-in roller 39 provided on the door leaf 11 in a state closing the entrance 101. In this way, the door leaf 11 is held while being biased in the direction to be pulled toward the side structure body 100. Note that, when the door leaf 11 is opened, operations opposite to the above ones are performed and the engaged state of the latch members 37 and the pull-in rollers 39 is released.

Figure 6:
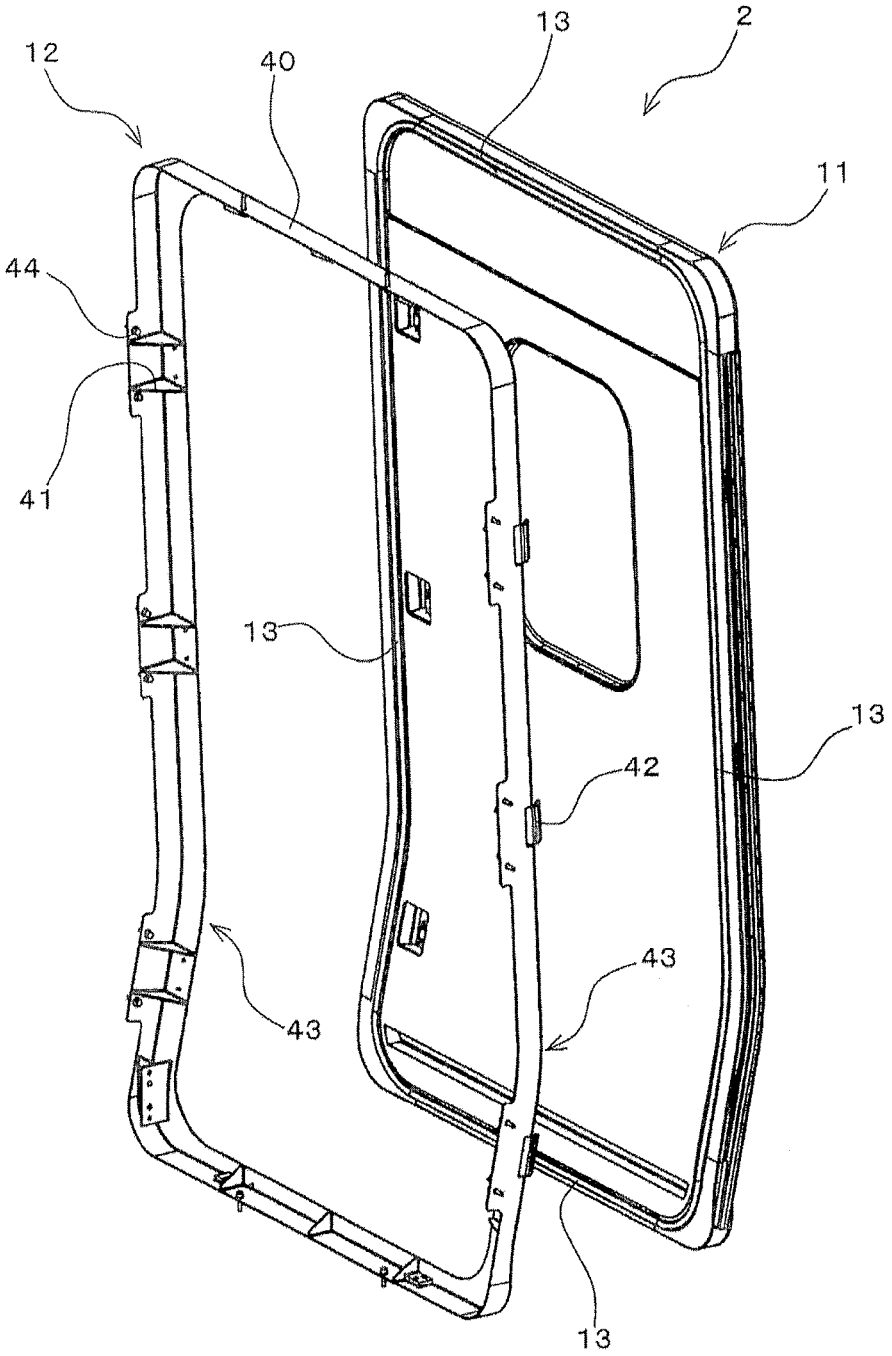
FIG. 6 is a perspective view schematically showing a railway vehicle plug door shown in FIG. 1.
Figure 7:
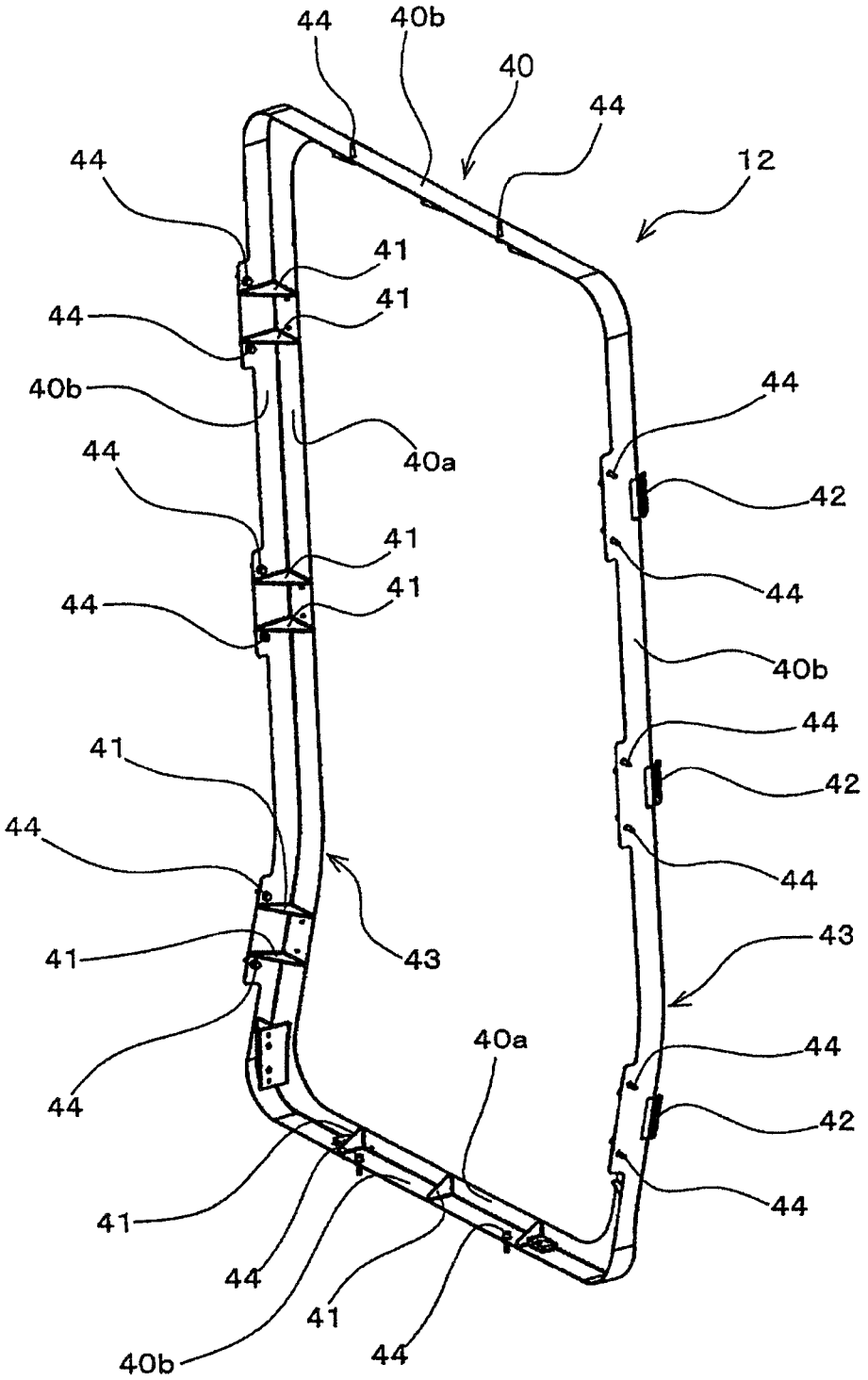
FIG. 7 is a perspective view schematically showing a frame body in the railway vehicle plug door shown in FIG. 6.
Figure 8:
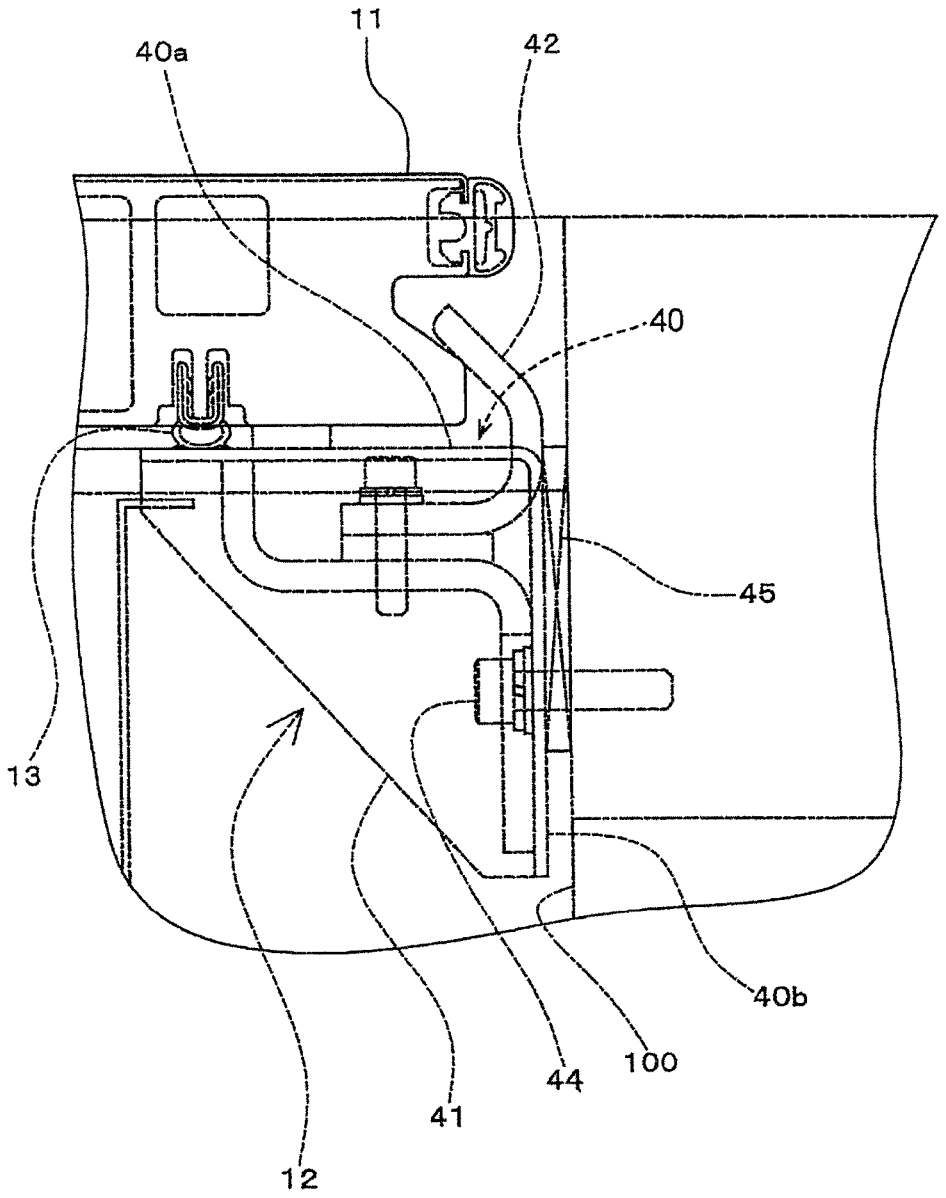
FIG. 8 is a diagram enlargedly showing a part of FIG. 2 to show the vicinity of an end part of a door head side of a door leaf.

Next, the plug door 2 according to this embodiment is described. The plug door 2 includes the door leaf 11 for opening and closing the entrance 101, a frame body 12, a seal member 13 and the like. FIG. 6 is a perspective view schematically showing the plug door 2. FIG. 7 is a perspective view schematically showing the frame body 12. FIG. 8 is a diagram enlargedly showing a part of FIG. 2 to show the vicinity of the end part of the door head side of the door leaf 11.

In this embodiment, the plug door 2 is formed as a single sliding door structure and one door leaf 11 for covering the entrance 101 is provided at the plug door 2. Further, the door leaf 11 is provided with a part bent in conformity with the shape of the side structure body 100 including the bent part. In this embodiment, a lower side of the door leaf 11 is formed into the bent part. Note that this bent part is formed as a part bent to moderately curved and protrude toward an outer side in the vehicle width direction as the door leaf 11 extends from bottom to top. Further, the door leaf 11 is provided with grooves, into which the seal member 13 to be described later is to be fitted, along an edge part of a surface facing the inner side in the vehicle width direction.

The frame body 12 is provided as a frame structure disposed along the entrance 101 over an entire circumference of the entrance 101. The frame body 12 is, for example, formed of a steel-made member. The frame body 12 includes a main body portion 40, a plurality of ribs 41, pulling-holding portions 42 and the like.

The main body portion 40 is configured as an annular structure body extending to have a substantially rectangular shape over the entire circumference of the entrance 101. The main body portion 40 includes a seal close-contact wall portion 40*a* and a mounting wall portion 40*b* which are integrally provided. The seal close-contact wall portion 40*a* and the mounting wall portion 40*b* are both provided as a plate-like part annularly extending to have a substantially rectangular shape over the entire circumference of the entrance 101. Note that the main body portion 40 comprising the seal close-contact wall portion 40*a* and the mounting wall portion 40*b* includes a bent portion 43 bent in conformity with the shape of the side structure body 100 including the bent part.

The seal close-contact wall portion 40*a* has a surface which is a surface facing an outer side in the vehicle width direction and with which the seal member 13 to be described later is to be held in contact. On the other hand, the mounting wall portion 40*b* has a surface extending along a direction substantially perpendicular to the seal close-contact wall portion 40*b*. The mounting wall portion 40*b* constitutes a part to be mounted in the side structure body 100 when the frame body 12 is mounted in the side structure body 100. Note that, due to the above configuration, the main body portion 40 is configured to have a cross-section extending along two sides of a right-angled triangle in a cross-section substantially perpendicular to a surface direction of the seal close-contact wall portion 40*a* and that of the mounting wall portion 40*b*.

The ribs 41 are provided as plate-like reinforcing members for reinforcing the main body portion 40 and mounted at a plurality of positions in a circumferential direction of the main body portion 40. Each rib 41 is mounted on a side of a minor angle out of angles formed by the integral intersection of the seal close-contact wall portion 40*a* and the mounting wall portion 40*b* with respect to the main body portion 40, i.e. on an inner side of the main body portion 40. Each rib 41 is provided as a plate-like member having a substantially triangular outer shape and fixed to the seal close-contact wall portion 40*a* and the mounting wall portion 40*b*. Note that each rib 41 is so mounted on the seal close-contact wall portion 40*a* and the mounting wall portion 40*b* that a surface direction of the plate-like rib 41 is substantially perpendicular to both the surface direction of the seal close-contact wall portion 40*a* and that of the mounting wall portion 40*b*.

As shown in FIG. 7, the pulling-holding portions 42 are provided as plate-like members bent to be curved and mounted at a plurality of positions on a door head side of the main body portion 40. As shown in FIG. 8, the pulling-holding portion 42 has a surface extending obliquely to the vehicle width direction. In this way, the pulling-holding portion 42 is configured to be engaged with a part of the end part of the door head side of the door leaf 11 on the obliquely extending surface at a timing at which the door leaf 11 is closed and the plugging operation is completed. Thus, the end part of the door head side of the door leaf 11 having closed the entrance 101 and completed with the plugging operation is held by being pressed in the direction to be pulled toward the inner side in the vehicle width direction.

The aforementioned frame body 12 is mounted on a part constituting the entrance 101 in the side structure body 100 by a mechanical fastening structure. Further, in this embodiment, the above mechanical fastening structure includes fastening members 44 provided separately from the side structure body 100 and the frame body 12 and is configured to fasten the side structure body 100 and the frame body 12 via the fastening members 44. The fastening members 44 are, for example, configured as bolts (see FIGS. 4 to 8).

In mounting the frame body 12 in the side structure body 100, the frame body 12 is first fitted to the part of the side structure body 100 constituting the entrance 101. At this time, the mounting wall portion 40*b* of the main body portion 40 of the frame body 12 is fitted to the side structure body 100. Then, the fastening members 44 are inserted into through holes provided on the mounting wall portion 40*b* of the frame body 12 from the inner side of the entrance 101 and threadably engaged with the side structure body 100 to be mounted. Bolt head parts of the fastening members 44 provided as bolts to be threadably engaged with the side structure body 100 come into contact with the mounting wall portion 40*b* and tighten the mounting wall portion 40*b*, whereby the fixing of the frame body 12 to the side structure body 100 by mechanical fastening using the fastening members 44 is completed. Note that if there is a clearance between the mounting wall portion 40*b* of the frame body 12 and the side structure body 100, a caulking material 45 or the like is appropriately filled in this clearance (see FIGS. 5 and 8). In this way, airtightness between the frame body 12 and the side structure body 100 is ensured. Note that the caulking material 45 has only to be a filler possible to be filled into the clearance and various filling materials can be used. Further, the caulking material may also be called a sealing material.

The seal member 13 shown in FIGS. 1 to 6 and 8 is provided as a seal member made of rubber for ensuring airtightness between the door leaf 11 and the frame body 12 by being held in close contact with both the door leaf 11 and the frame body 12 when the door leaf 11 closes the entrance 101. Specifically, the seal member 13 is held in close contact with both the frame body 12 and the door leaf 11 when the door leaf 11 is pressed against the frame body 12 mounted in the side structure body 100 by the plugging operation. In this way, the seal member 13 ensures airtightness between the door leaf and the frame body 12. Further, in this embodiment, the seal member 13 is mounted on the door leaf 11. The door leaf 11 is provided with the grooves along the edge part on the surface facing the inner side in the vehicle width direction as described above and the seal member 13 is fitted into the grooves.

Further, the seal member 13 is configured as an annular seal member having a substantially rectangular shape along the edge part of the door leaf 11. The seal member 13 is disposed to correspond, in the state where the entrance 101 is closed by the door leaf 11, to the entire circumference of the entrance 101 along the entrance 101. Specifically, the seal member 13 is disposed on the door leaf 11 to be held in close contact with the frame body 12 over the entire circumference of the entrance 101 when the door leaf 11 is closed.

Figure 9:
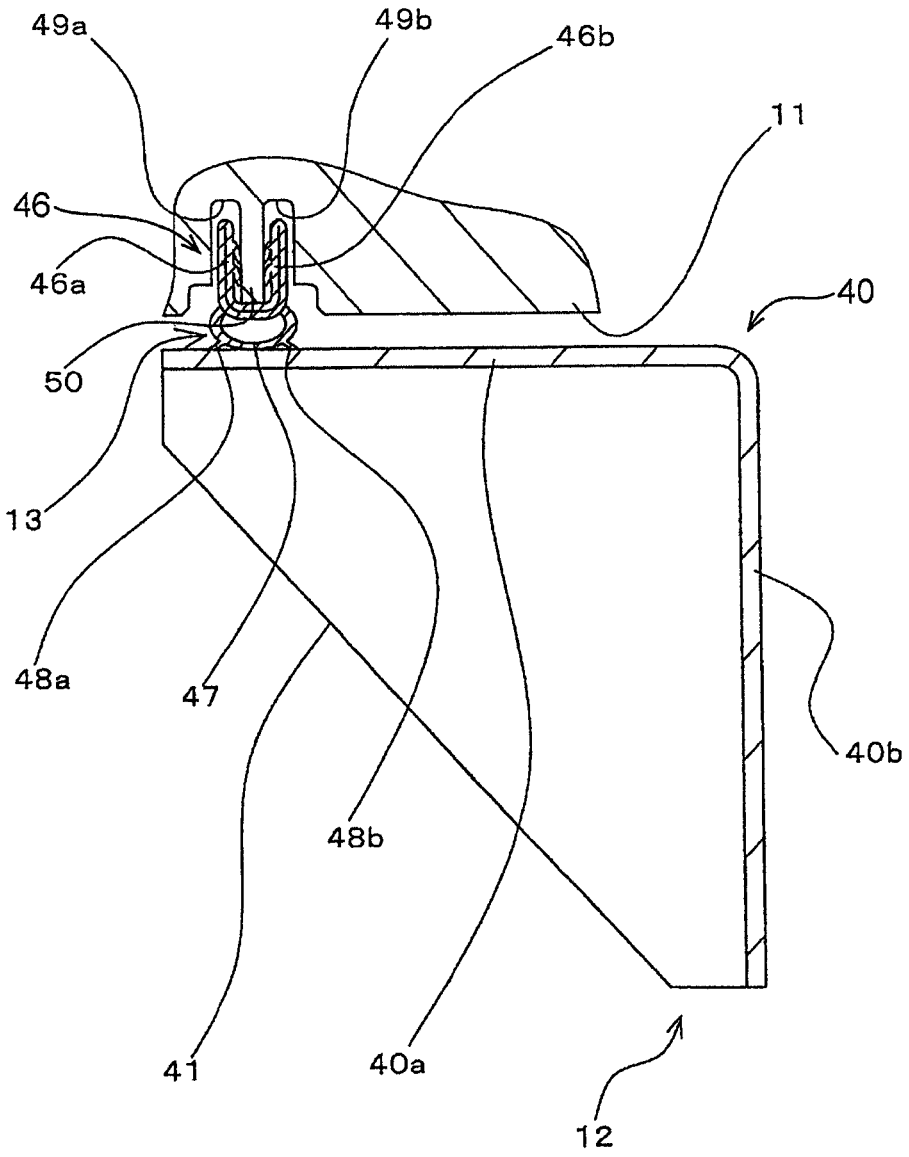
FIG. 9 is a diagram schematically showing cross-sections of the frame body and a seal member of the railway vehicle plug door viewed from a position indicated by arrows C-C of FIG.
Figure 10:
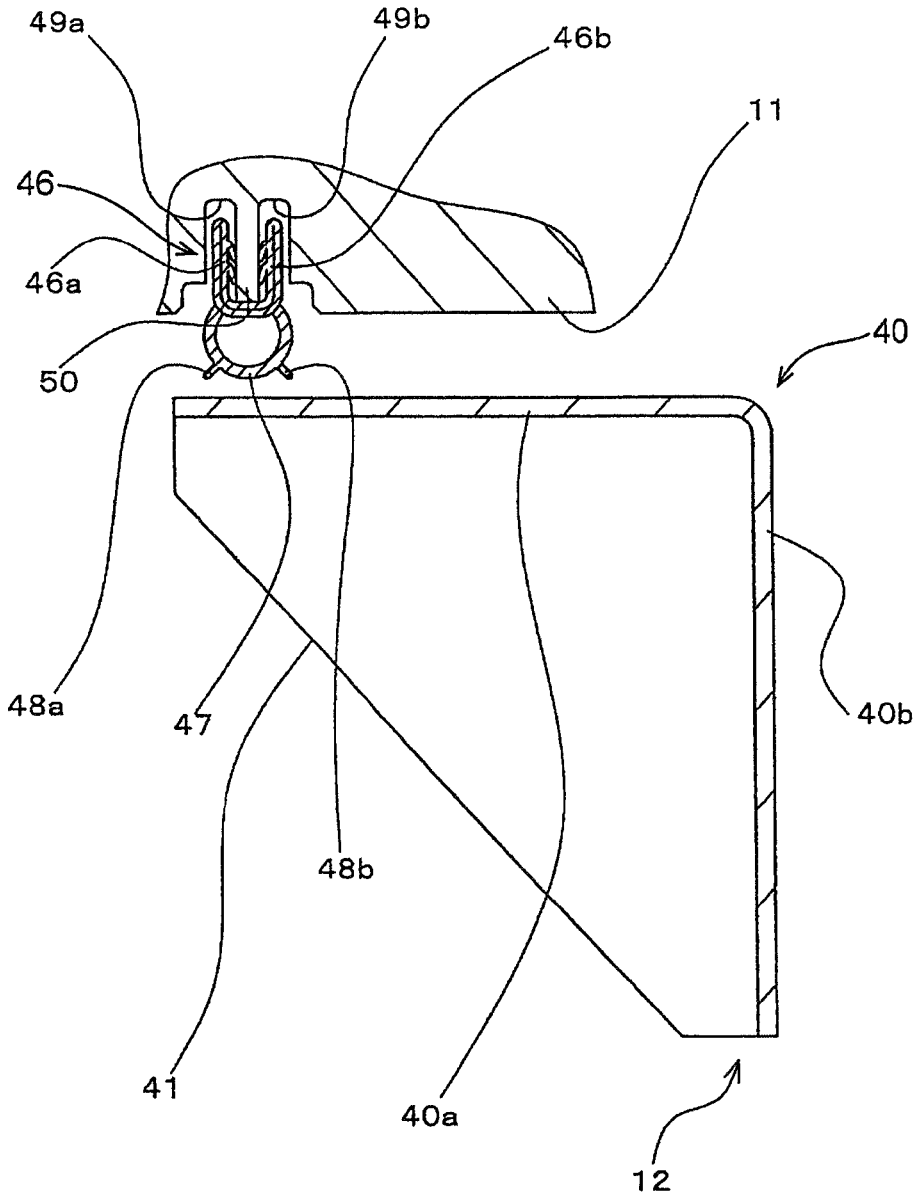
FIG. 10 is a diagram schematically showing a state where the frame body and the seal member of the railway vehicle plug door shown in FIG. 9 are separated from each other.

FIG. 9 is a diagram schematically showing cross-sections of the frame body 12 and the seal member 13 of the plug door 2 viewed from a position indicated by arrows C-C of FIG. 1. FIG. 10 is a diagram schematically showing a state where the frame body 12 and the seal member 13 shown in FIG. 9 are separated from each other. As shown in FIGS. 9 and 10, the seal member 13 includes a mounting portion 46, an annular close-contact portion 47 and a pair of convex close-contact portions (48*a*, 48*b*).

The mounting portion 46 is provided as a part to be mounted on the door leaf 11 and includes a pair of fitting wall portions (46*a*, 46*b*) annularly extending to have a substantially rectangular shape. The door leaf 11 is provided with a pair of grooves (49*a*, 49*b*), into which the pair of fitting wall portions (46*a*, 46*b*) are to be fitted, along an edge part on the surface facing the inner side in the vehicle width direction. The fitting wall portion 46*a* is fitted into the groove 49*a* corresponding to the inner side of the entrance 101 and the fitting wall portion 46*b* is fitted into the groove 49*b* corresponding to the outer side of the entrance 101.

Further, the pair of fitting wall portions (46*a*, 46*b*) are mounted on a convex wall portion 50 while sandwiching the convex wall portion 50 extending along the edge part of the door leaf 11 between the pair of grooves (49*a*, 49*b*). Note that each fitting wall portion (46*a*, 46*b*) includes a plurality of fin-like projections to be held in contact with a side surface of the convex wall portion 50 in a hooking manner over the entire circumference on a side facing the other fitting wall portion. Each fin-like projection is continuously provided over the entire circumference of the corresponding fitting wall portion (46*a*, 46*b*) and is elastically deformed and held in close contact with the convex wall portion 50 while being inclined inwardly in the vehicle width direction in a state where the convex wall portion 50 is fitted between the pair of fitting wall portions (46*a*, 46*b*). In this way, the detachment of the seal member 13 from the door leaf 11 is prevented.

The annular close-contact portion 47 is provided as a part to be held in close contact with the seal close-contact wall portion 40*a* of the frame body 12 when the door leaf 11 is closed, and annularly extends to have a substantially rectangular shape along the edge part of the door leaf 11. Further, a cross-section of the annular close-contact portion 47 annularly extending to have a substantially rectangular shape is a hollow annular cross-section.

Further, as shown in FIG. 10, the annular close-contact portion 47 is formed to have a substantially circular cross-section in the state where the frame body 12 and the seal member 13 are separated from each other. On the other hand, the annular close-contact portion 47 is elastically deformed to squeeze the substantially circular cross-section and has a substantially elliptical cross-section as shown in FIG. 9 in a state where the door leaf 11 is closed and the seal member 13 is held in close contact with the frame body 12.

The pair of convex close-contact portions (48*a*, 48*b*) are in the form of fins projecting from the annular close-contact portion 47 and provided as convex parts annularly extending to have a substantially rectangular shape along the annular close-contact portion 47. Each convex close-contact portion (48*a*, 48*b*) is provided as a part to be held in contact with the seal close-contact wall portion 40*a* of the frame body 12 together with the annular close-contact portion 47 when the door leaf 11 is closed.

Further, each convex close-contact portion (48*a*, 48*b*) is, for example, provided to project from the annular close-contact portion 47 along a radial direction of the substantially circular cross-section of the annular close-contact portion 47. An angle formed between a projecting direction of one convex close-contact portion 48*a* from the annular close-contact portion 47 and that of the other convex close-contact portion 48*b* from the annular close-contact portion 47 is set, for example, at about 120° on a minor angle side. The pair of convex close-contact portions (48*a*, 48*b*) are so provided on the annular close-contact portion 47 that a bisector bisecting the angle formed between the projecting directions of the pair of convex close-contact portions (48*a*, 48*b*) is substantially perpendicular to a wall surface of the seal close-contact wall portion 40*a*.

Further, the pair of convex close-contact portions (48*a*, 48*b*) are so elastically deformed to increase the angle formed by the pair of convex close-contact portions (48*a*, 48*b*) toward outer sides when being held in close contact with the seal close-contact wall portion 40*a*. Specifically, the pair of convex close-contact portions (48*a*, 48*b*) are held in close contact with the seal close-contact wall portion 40*a* in a state where tip sides thereof are elastically deformed to be opened outward and separated from each other (see FIG. 9).

The seal member 13 mounted on the door leaf 11 is held in close contact with the seal close-contact wall portion 40*a* of the frame body 12 at three positions, i.e. at the annular close-contact portion 47 and the pair of convex close-contact portions (48*a*, 48*b*) as shown in FIG. 9 by having the aforementioned cross-sectional structure. Specifically, the seal member 13 is in contact with the frame body 12 at three positions in a cross-section along a direction parallel to a direction of pressing the seal member 13 against the frame body 12 and an outward direction from the entrance 101 along the side structure body 100 when the door leaf 11 closes the entrance 101 to press the seal member 13 against the frame body 12 and bring the seal member 13 into contact with the frame body 12.

Note that door stoppers 52 are mounted on the frame body 12 to prevent an elastic deformation amount of the seal member 13 from exceeding a maximum compression amount allowable in design in the seal member 13 when the seal member 13 is elastically deformed and comes into close contact with the seal close-contact wall portion 40*a* as described above (see FIG. 5). The door stoppers 52 are, for example, formed of a rubber member and so made of a material and dimensioned as to sufficiently receive a pressure exerted from the door leaf 11. The door stoppers 52 are mounted on the seal close-contact wall portion 40*a* of the frame body 12 at a plurality of positions (e.g. ten positions) dispersed over the entire circumference in a circumferential direction of the frame body 12.

As described above, according to the railway vehicle plug door device 1, the frame body 12 provided separately from the side structure body 100 is mounted in the part constituting the entrance 101 in the side structure body 100 of the railway vehicle. The frame body 12 is mounted in the side structure body 100 by the mechanical fastening structure. Thus, even if the side structure body 10 has a structure assembled by joining the structural members by welding and a complicated cross-sectional shape by including the bent part, the influence of a distortion of the side structure body 100 caused by a residual stress due to welding on the frame body 12 can be easily reduced. Since the seal member 13 is mounted on the door leaf 11 and held in close contact with the frame body 12, the influence of the distortion of the side structure body 100 caused by the residual stress due to welding on the close contact of the seal member 13 is also largely reduced. In this way, a structure is realized which easily reduces the influence of the above distortion on airtightness between the side structure body 100 and the door leaf 11. Thus, it is possible to provide the railway vehicle plug door device 1 easily ensuring airtightness between the side structure body 100 and the door leaf 11.

As described above, according to this embodiment, even if the railway vehicle plug door device 1 is installed in the side structure body 100 having a structure assembled by joining the structural members by welding and including the bent part, airtightness between the side structure body 100 and the door leaf 11 can be easily ensured.

Further, effects similar to the above ones can also be achieved by the railway vehicle plug door 2. Specifically, even if the railway vehicle plug door 2 is installed in the side structure body 100 having a structure assembled by joining the structural members by welding and including the bent part, airtightness between the side structure body 100 and the door leaf 11 can be easily ensured.

Further, according to the railway vehicle plug door device 1, the frame body 12 and the seal member 13 are arranged along the entrance 101 over the entire circumference of the entrance 101 in the closed state of the door leaf 11. Thus, airtightness between the side structure body 100 and the door leaf 11 can be more easily ensured.

Further, according to the railway vehicle plug door device 1, the side structure body 100 and the frame body 12 are mechanically fastened via the fastening members 44 separate from the side structure body 100 and the frame body 12. Thus, the frame body 12 can be easily mounted in the side structure body 100. Further, since the frame body 12 is fastened to the side structure body 100 via the separate fastening members 44, a structure capable of easily reducing the influence of a distortion of the side structure body 100 caused by a residual stress due to welding on the frame body 12 can be more easily realized.

Further, according to the railway vehicle plug door device 1, the seal member 13 is in contact with the frame body 12 at three positions in the cross-section along the direction parallel to the direction of pressing the seal member 13 against the frame body 12 and the outward direction from the entrance 101 along the side structure body 100. Thus, the contact state of the seal member 13 with the frame body 12 can be efficiently ensured at three dispersed positions as compared with the case where the seal member 13 is in contact only at one or two positions. In this way, airtightness between the side structure body 100 and the door leaf 11 can be more easily ensured.

Although the embodiment of the present invention has been described above, the present invention is not limited to the above embodiment and various changes can be made within the scope of claims. For example, the following changes may be made.

(1) Although the present invention is applied to the single sliding door structure including one door leaf in the above embodiment, there is no limitation to this example and the present invention may be applied to a double sliding door structure including two door leaves.

(2) Although the seal member is mounted on the door leaf in the above embodiment, it may not be as this. The seal member has only to be mounted on at least one of the door leaf and the frame body.

(3) Although the seal member is disposed to correspond to the entire circumference of the entrance in the above embodiment, it may not be as this. The seal member may be disposed to partially correspond to the entrance in the circumferential direction.

(4) Although the seal member mounted on the door leaf is in contact with the frame body at three positions in the predetermined cross-section in the above embodiment, it may not be as this. The seal member mounted on one of the door leaf and the frame body may be in contact with the other of the door leaf and the frame body at one, two, four or more positions in the predetermined cross-section.

(5) The mechanical fastening structure for mounting the frame body in the side structure body is not limited to the one illustrated in the above embodiment and various changes may be made. For example, the frame body may be mounted in the side structure body by a mechanical fastening structure including bolts and nuts, rivets or the like as fastening members provided separately from the side structure body and the frame body. Further, the frame body may be mounted in the side structure body by a mechanical fastening structure of fitting the frame body to the side structure body without including any fastening member provided separately from the side structure body and the frame body.

(6) Although the door driving mechanism includes the electric motor, the drive pulley, the driven pulley and the belt in the above embodiment, it may not be as this. For example, a door driving mechanism including an electric motor and a rack and pinion mechanism may be employed. Further, a door driving mechanism including an electric motor, a screw shaft and a nut member which moves by being threadably engaged with the screw shaft may be employed. Further, a door driving mechanism including a hydraulically operated actuator or a pneumatically operated actuator without including any electric motor may be employed.

(7) Although the pull-in actuator includes the electric motor, the spur gear having a small diameter, the spur gear having a large diameter, the rotary shaft and the latch members in the above embodiment, there is no limitation to this example and a variously changed pull-in actuator may be employed. For example, a pull-in actuator including a hydraulically operated actuator or a pneumatically operated actuator without including any electric motor may be employed. Further, a pull-in actuator mechanism interlocked with the door driving mechanism may be employed instead of the pull-in actuator independent of the door driving mechanism.

(8) Although the guide rail configured as a rail member for guiding the moving direction of the door hanger is described as a guide mechanism in the above embodiment, the guide mechanism may not be as this. Specifically, the guide mechanism has only to be a mechanism for guiding the door leaf in the vehicle width direction and a member other than in the form of a rail member may be employed as the guide mechanism. Further, a guide mechanism including an actuator capable of driving the door leaf in the vehicle width direction may be employed.

(9) When being mounted in the side structure body, the frame body may be mounted in the side structure body in various ways. For example, the frame body and the door leaf may be separately mounted in the side structure body. Further, the frame body may be mounted in the side structure body in a state where the frame body and the door leaf are temporarily assembled. Here, a way of mounting the frame body in the side structure body in the state where the frame body and the door leaf are temporarily assembled is further described.

Figure 11:
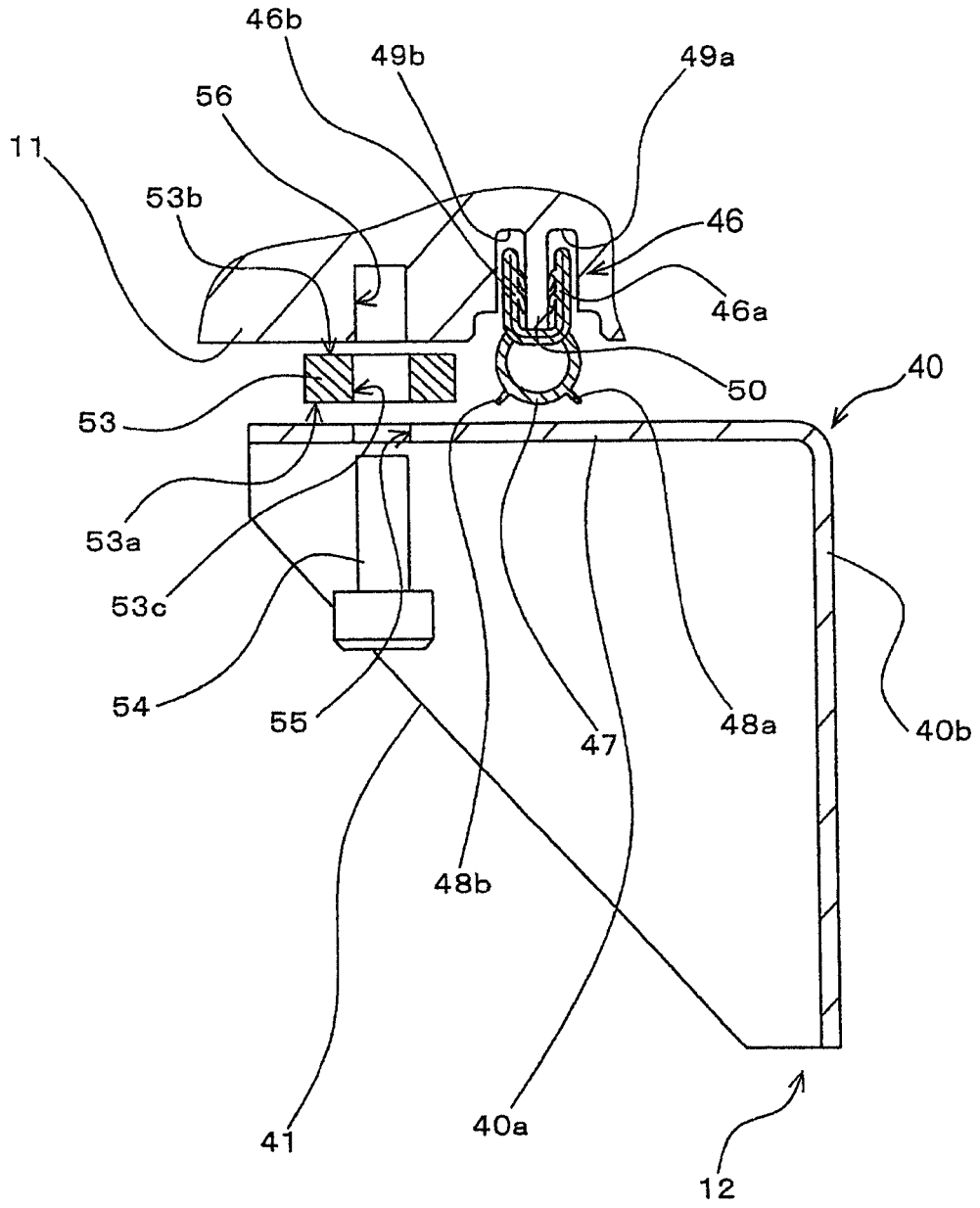
FIG. 11 is a diagram showing a state where the frame body and the door leaf of the railway vehicle plug door shown in FIG. 1 are mounted in the side structure body while the frame body and the door leaf are temporarily assembled.

FIG. 11 is a diagram showing how to mount the frame body 12 and the door leaf 11 of the plug door 2 shown in FIG. 1 in the side structure body 100 in a temporarily assembled state. FIG. 11 is a diagram schematically showing a cross-section of the plug door 2 corresponding to FIG. 10. Note that, in the following description, elements configured similarly to those of the above embodiment are not described by being denoted by the same reference signs or quoting the same reference signs in FIG. 11.

In temporarily assembling the frame body 12 and the door leaf 11, a separator 53 is used as shown in FIG. 11. The separator 53 is, for example, configured as a long and narrow plate-like member. Specifically, this separator 53 is configured as a long and narrow plate-like member having a rectangular outer cross-sectional shape as shown in FIG. 11 and having a longitudinal direction. Further, the separator 53 is, for example, formed of a resin material.

In temporarily assembling the frame body 12 and the door leaf 11, the separator 53 is arranged between the seal close-contact wall portion 40*a* and the door leaf 11. Further, in this case, a plurality of separators 53 are used and arranged along the main body portion 40 having a substantially rectangular shape. For example, four long separators 53 are used and each separator 53 is arranged along a corresponding part of each of four sides of the substantially rectangular main body portion 40. Specifically, two out of the four separators 53 are arranged to extend in a front-back direction (direction parallel to the front-back direction of the railway vehicle) of the frame body 12 along the seal close-contact wall portion 40*a* on upper and lower parts of the frame body 12. Further, the remaining two separators 53 are arranged to extend in a vertical direction (direction perpendicular parallel to the front-back direction of the railway vehicle) of the frame body 12 along the seal close-contact wall portion 40*a* on front and rear parts of the frame body 12.

Further, the separator 53 is provided as a plate-like member having a constant thickness and so arranged that one surface 53*a* in a thickness direction is held in close contact with the seal close-contact wall portion 40*a* and another surface 53*b* in the thickness direction is held in close contact with the door leaf 11. By arranging the separators 53 in this way, a clearance dimension between the frame body 12 and the door leaf 11 is kept at a predetermined dimension determined by the thickness of the separators 53 in the state where the frame body 12 and the door leaf 11 are temporarily assembled.

In temporarily assembling the frame body 12 and the door leaf 11, the frame body 12 and the door leaf 11 are temporarily fixed in a temporarily fixed state using temporary assembling screws 54 in a state where the separators 53 are sandwiched between the frame body 12 and the door leaf 11. Specifically, by temporarily fixing the frame body 12 and the door leaf 11 via the separators 53 using the temporary assembling screws 54, the frame body 12 and the door leaf 11 are temporarily assembled.

Through holes 53*c* through which screw shaft parts of the temporary assembling bolts 54 are inserted are formed to penetrate through the separator 53. Through holes 55 through which the temporary assembling bolts 54 are inserted are also formed to penetrate through the seal close-contact wall portion 40*a* of the frame body 12 to correspond to the through holes 53*c*. Further, screw holes 56 as female screw holes to be threadably engaged with the screw shaft parts, which are male screw parts of the temporarily assembling screws 54, are provided on the door leaf 11. By inserting the temporarily assembling screws 54 through the through holes 55 and 53*c* and threadably engaging them with the screw holes 56 in the state where the separators 53 are sandwiched between the frame body 12 and the door leaf 11, the frame body 12 and the door leaf 11 are temporarily assembled.

In the temporarily assembled state as described above, the clearance dimension between the frame body 12 and the door leaf 11 is kept at the predetermined dimension by the separators 53. Thus, the elastic deformation amount of the seal member 13 when the seal member 13 is pressed against the seal close-contact wall portion 40*a* is kept at a substantially constant deformation amount. Specifically, in temporarily assembling the frame body 12 and the door leaf 11, the seal member 13 is pressed against the seal close-contact wall portion 40*a* at a substantially constant sealing pressure. In this way, the frame body 12 and the door leaf 11 are temporarily assembled using the temporarily assembling screws 54 while a seal squeezing margin by the seal member 13 is kept substantially uniform by the separators 53.

Further, the separators 53 are arranged closer to a central side of the entrance 101 than the seal member 13. Specifically, the separators 53 are arranged at the inner side of the seal member 13 annularly extending to have a substantially rectangular shape along the edge part of the door leaf 11. Thus, it is not necessary to provide seal cap members or the like for closing the through holes 55 when the mounting of the frame body 12 and the door leaf 11 in the side structure body 100 is completed, whereby a seal structure can be simplified. Note that when the mounting of the frame body 12 and the door leaf 11 in the side structure body 100 is completed, the separators 53 and the temporarily assembling screws 54 are removed to cancel the temporarily assembled state of the frame body 12 and the door leaf 11. At this time, since the through holes 55 are arranged at the inner side of the annular seal member 13, it is not necessary to provide seal cap members or the like for closing the through holes 5 as described above.

Figure 12:
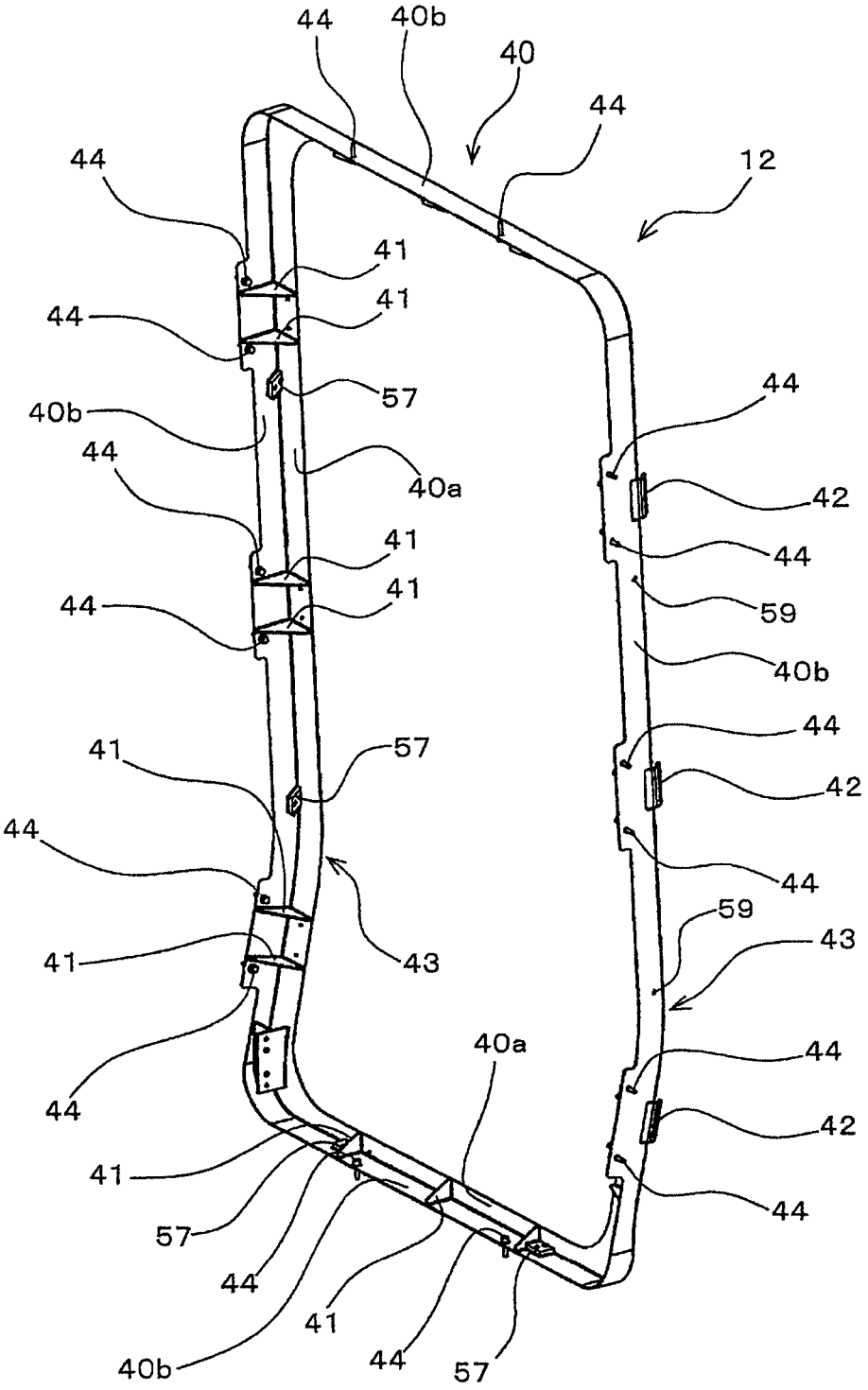
FIG. 12 is a perspective view schematically showing the frame body in a state where the temporary assembling of the frame body and the door leaf is released after the temporarily assembled frame body and door leaf are mounted in the side structure body.

Next, an operation of mounting the frame body 12 and the door leaf 11 temporarily assembled as described above in the side structure body 100 is described. FIG. 12 is a perspective view schematically showing the frame body 12 in a state where the temporary assembling of the frame body 12 and the door leaf 11 is released after the temporarily assembled frame body 12 and door leaf 11 are mounted in the side structure body 100. In mounting the temporarily assembled frame body 12 and door leaf 11 in the side structure body 100, the positions of the frame body 12 and the door leaf 11 with respect to the side structure body 100 in the vertical direction and the front-back direction of the railway vehicle are adjusted. A plurality of blocks 57 shown in FIG. 12 are used in adjusting the above positions of the frame body 12 and the door leaf 11 with respect to the side structure body 100.

Figure 13:
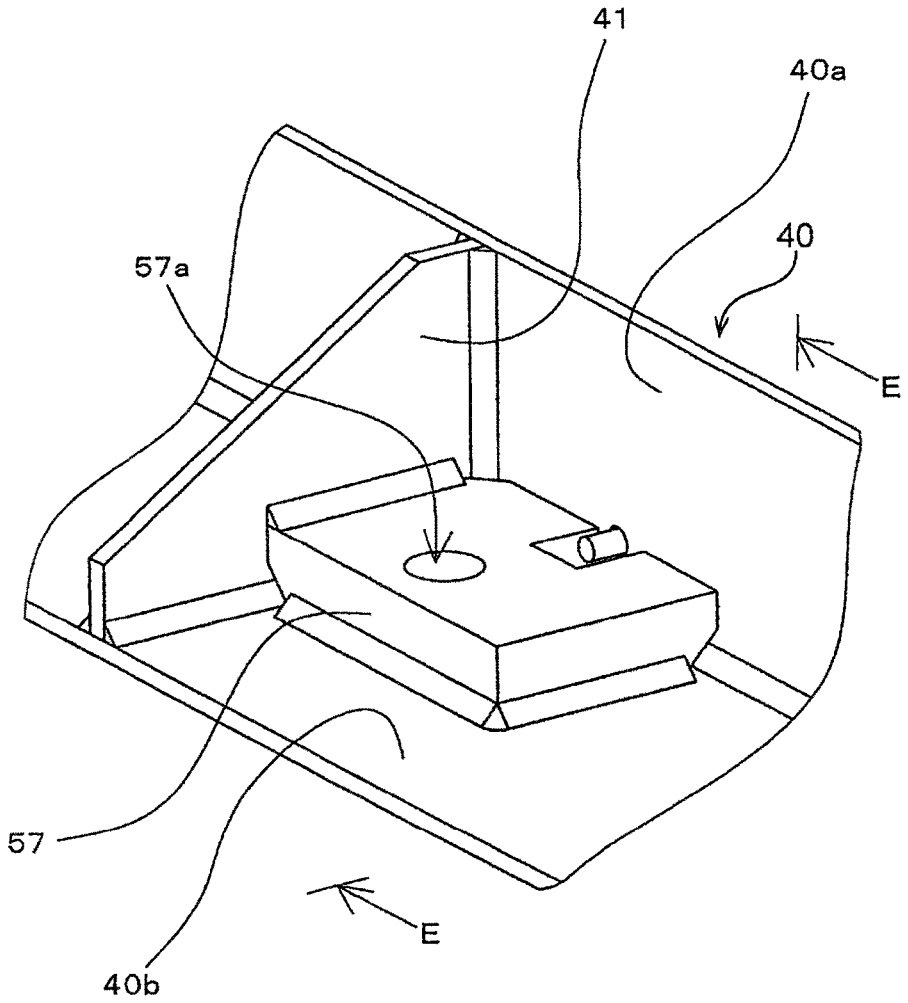
FIG. 13 is a diagram enlargedly showing a part of FIG. 12 to show a block disposed on a mounting wall portion on a lower part of the frame body and a part near the block.

For example, as shown in FIG. 12, two blocks 57 are fixed to the mounting wall portion 40*b* of a lower part of the frame body 12, the mounting wall portion 40*b* of a front part of the frame body 12, and the mounting wall portion 40*b* of a rear part of the frame body 12, respectively. FIG. 13 is a diagram enlargedly showing a part of FIG. 12 to show the block 57 disposed on the mounting wall portion 40*b* of the lower part of the frame body 12 and a part near the block 57. As shown in FIG. 13, the block 57 is provided with a screw hole 57*a* to be threadably engaged with a position adjusting bolt (position adjusting bolt is not shown in FIG. 13) for adjusting the position of the frame body 12 with respect to the side structure body 100. The screw hole 57*a* is formed as a female screw hole through which a male screw part of the position adjusting bolt is inserted to be threadably engaged. Note that each of the six blocks 57 disposed on the frame body 12 is configured similarly to the block 57 shown in FIG. 13. Further, a through hole 59 (see FIGS. 12 and 14 to be described later) through which the position adjusting bolt is inserted is provided at a position of the mounting wall portion 40*b* of the frame body 12 corresponding to each screw hole 57*a*.

When the frame body 12 and the door leaf 11 are mounted in the side structure body 100, the temporarily assembled frame body 12 and door leaf 11 are arranged in a part of the side structure body 100 corresponding to the periphery of the entrance 101. By adjusting the positions of the position adjusting bolts threadably engaged with the blocks 57 with respect to the blocks 57, the positions of the frame body 12 and the door leaf 11 with respect to the side structure body 100 are adjusted. At this time, by adjusting the positions of threadable engagement of the position adjusting bolts with the blocks 57 in a state where tip parts of the position adjusting bolts are in contact with the side structure body 100, relative positions of the frame body 12 and the door leaf 11 with respect to the side structure body 100 are adjusted.

Further, by adjusting the positions of threadable engagement of the position adjusting bolts with the respective blocks 57 disposed on the respective mounting wall portions 40*b* of the front and rear parts of the frame body 12, the positions of the frame body 12 and the door leaf 11 with respect to the side structure body 100 in the front-back direction of the railway vehicle are adjusted. Then, by adjusting the positions of threadable engagement of the position adjusting bolts with the respective blocks 57 disposed on the mounting wall portion 40*b* of the lower part of the frame body 12, the positions of the frame body 12 and the door leaf 11 with respect to the side structure body 100 in the vertical direction of the railway vehicle are adjusted.

As described above, the positions of the frame body 12 and the door leaf 11 with respect to the side structure body 100 are adjusted in the front-back direction and the vertical direction of the railway vehicle. In this way, a position adjustment to ensure airtightness between the side structure body 100 and the door leaf 11 is performed. More specifically, the positions of the frame body 12 and the door leaf 11 with respect to the side structure body 100 are so adjusted that the positions of the bent parts of the frame body 12 and the door leaf 11 correspond to the position of the bent part of the side structure body 100.

Figure 14:
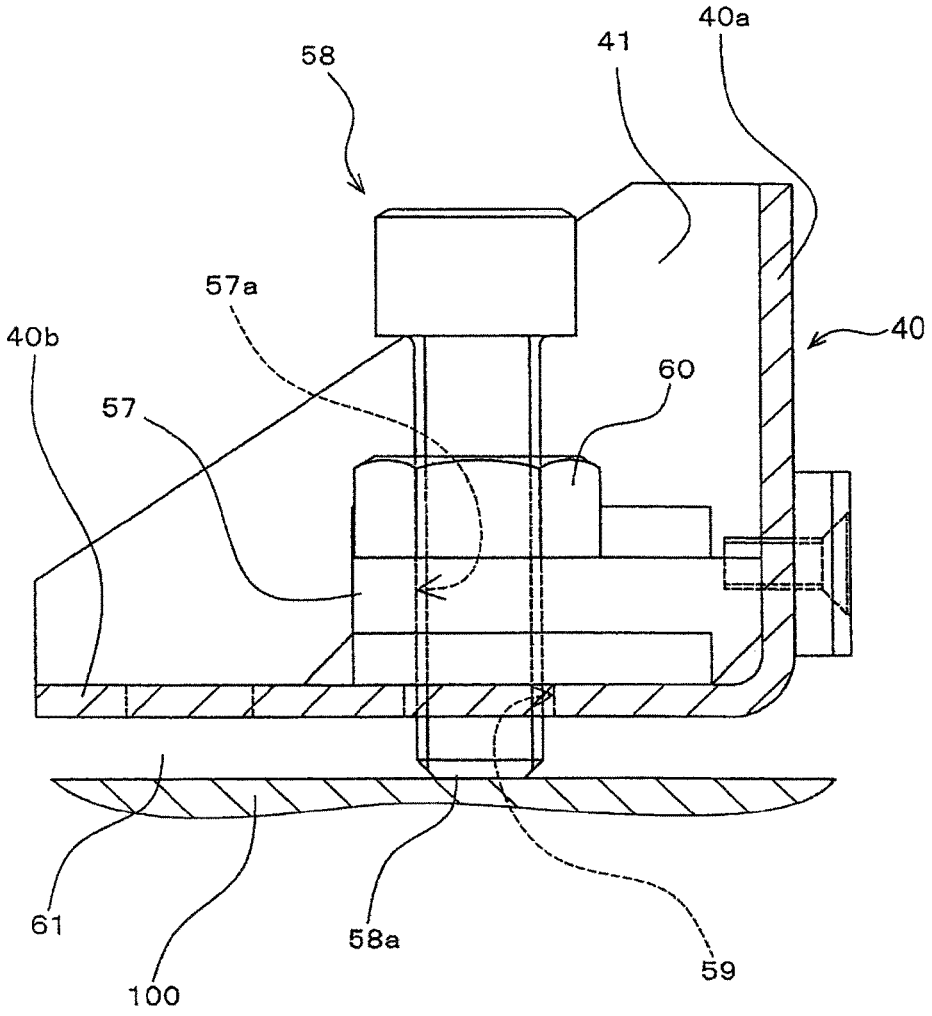
FIG. 14 is a diagram, corresponding to a cross-section viewed from a position indicated by arrows E-E of FIG. 13, showing a position adjusting operation using the block shown in FIG. 13.

Here, the above position adjusting operation is further described, taking as an example a position adjusting operation using the blocks 57 disposed on the lower part of the frame body 12. FIG. 14 is a diagram, corresponding to a cross-section viewed from a position indicated by arrows E-E of FIG. 13, showing the position adjusting operation using the block 57 shown in FIG. 13.

The aforementioned position adjusting bolt 58 configured as a position adjusting bolt penetrates through the block 57 in a state threadably engaged with the screw hole 57*a* of the block 57. The screw shaft of the position adjusting bolt 58 as the male screw part is inserted through the through hole 59 so that a tip part 58*a* thereof projects outwardly from the inside of the frame body 12. Further, the tip part 58*a* of the position adjusting bolt 58 is in contact with the side structure body 100.

By adjusting the position of threadable engagement of the position adjusting bolt 58 with the block 57 in the above state, the positions of the frame body 12 and the door leaf 11 with respect to the side structure body 100 are adjusted. Specifically, since the contact position of the tip part 58*a* of the position adjusting bolt 58 with the side structure body 100 does not change, the positions of the frame body 12 and the door leaf 11 with respect to the side structure body 100 change as the position of threadable engagement of the position adjusting bolt 58 with the block 57 changes.

Note that a nut 60 arranged on a bolt head side of the position adjusting bolt 58 with respect to the block 57 is threadably engaged with the position adjusting bolt 58. In a state where the nut 60 threadably engaged with the position adjusting bolt 58 is in contact with the block 57, a displacement of the position of threadable engagement of the position adjusting bolt 58 with the block 57 is prevented. On the other hand, in changing the position of threadable engagement of the position adjusting bolt 58 with the block 57, the nut 60 is operated to be separated from the block 57.

Upon the completion of the position adjusting operation of the frame body 12 and the door leaf 11 with respect to the side structure body 100 by adjusting the position of threadable engagement of the position adjusting bolts 58 with the blocks 57, a main fixing operation of fixing the frame body 12 to the side structure body 100 is performed. Specifically, the frame body 12 is fixed to the side structure body 100 by mechanical fastening using the fastening members 44. Then, the door leaf 11 is installed in the railway vehicle via the hanger 31 and the like.

Further, during the above main fixing operation, a plate member such as a shim is disposed in a clearance between the frame body 12 and the side structure body 100 as shown as a clearance 61 in FIG. 14. Further, when the above main fixing operation is finished, the separators 53 and the temporary assembling screws 54 are removed to release the temporarily assembled state of the frame body 12 and the door leaf 11. Note that, when the plate member such as a shim is disposed in the above clearance and the above main fixing operation is finished, a filler such as a caulking material or a sealing material is filled into a space of the above clearance where the plate member such as a shim is not arranged. In the above manner, the mounting operation of the frame body 12 and the door leaf 11 in the side structure body 100 is completed.

According to the aforementioned work form, the frame body 12 and the door leaf 11 are mounted in the side structure body 100 in the temporarily assembled state, wherefore fitting man-hour in fitting the plug door 2 to the railway vehicle can be reduced.

INDUSTRIAL APPLICABILITY

The present invention can be widely applied as a railway vehicle plug door device which is installed at an entrance of a railway vehicle and performs an operation of opening and closing a door leaf and a plugging operation of moving the door leaf in a width direction of the railway vehicle and as a railway vehicle plug door used as a door structure in the railway vehicle plug door device.

EXPLANATION OF REFERENCE SIGNS

1 plug door device
2 railway vehicle plug door
11 door leaf
12 frame body
13 seal member
21 door driving mechanism
22 guide rail (guide mechanism)
100 side structure body
101 entrance

The invention claimed is:

1. A railway vehicle plug door device to be installed at an entrance of a railway vehicle and configured to perform an operation of opening and closing a door leaf and a plugging operation of moving the door leaf in a width direction of the railway vehicle, comprising:

a door driving mechanism including a motor for generating a power for opening and closing the door leaf;

an annular frame body to be disposed along a periphery of the entrance defined in a side wall of the railway vehicle and to be mounted on the side wall by a mechanical fastening structure;

a door leaf having a shape for opening and closing the entrance;

an annular seal member mounted on at least one of the door leaf or the frame body and held in close contact with both the door leaf and the frame body when the door leaf closes the entrance, the door leaf having screw holes and the frame body having a surface which faces an outer side in the vehicle width direction and with which the seal member is to be held in contact, and through holes formed on the surface of the frame body at positions that correspond to the respective screw holes on the door leaf when the door leaf closes the entrance, wherein the surface of the frame body and the screw holes of the door leaf face each other in the vehicle width direction, said screw holes do not penetrate through the door leaf, wherein the screw holes and the through holes are formed in regions of the door leaf and the frame body, respectively, wherein the regions are inward of and surrounded by the annular seal member.

2. A railway vehicle plug door device according to claim 1, wherein:

the mechanical fastening structure includes a fastening member provided separately from the side wall and the frame body and fastens the side wall and the frame body via the fastening member.

3. A railway vehicle plug door device according to claim 1, wherein:

the seal member is mounted on the door leaf and is in contact with the frame body at least at three positions in a cross section along a direction parallel to a direction of pressing the seal member against the frame body and an outward direction from the entrance along the side wall when the seal member comes into contact with and being pressed against the frame body by closing the entrance by the door leaf.

4. A railway vehicle plug door used as a door structure including a door leaf in a plug door device to be installed at an entrance of a railway vehicle and configured to perform an operation of opening and closing the door leaf and a plugging operation of moving the door leaf in a width direction of the railway vehicle, comprising:

an annular frame body to be disposed along a periphery of the entrance defined in a side wall of the railway vehicle and to be mounted on the side wall by a mechanical fastening structure;

a door leaf having a shape for opening and closing the entrance;

an annular seal member mounted on at least one of the door leaf or the frame body and held in close contact with both the door leaf and the frame body when the door leaf closes the entrance, the door leaf having screw holes and the frame body having a surface which faces an outer side in the vehicle width direction and with which the seal member is to be held in contact, and through holes formed on the surface of the frame body at positions that correspond to the respective screw holes on the door leaf when the door leaf closes the entrance, wherein the surface of the frame body and the screw holes of the door leaf face each other in the vehicle width direction, said screw holes do not penetrate through the door leaf, wherein the screw holes and the through holes are formed in regions of the door leaf and the frame body, respectively, wherein the regions are inward of and surrounded by the annular seal member.

5. A railway vehicle plug door device according to claim 1, wherein: the seal member is mounted on the frame body and is in contact with the door leaf at least at three positions in a cross section along a direction parallel to a direction of pressing the seal member against the door leaf and an outward direction from the entrance along the side wall when the seal member comes into contact with and being pressed against the door leaf by closing the entrance by the door leaf.

* * * * *